US010919680B1

(12) United States Patent
Philips

(10) Patent No.: US 10,919,680 B1
(45) Date of Patent: Feb. 16, 2021

(54) LIQUID BEVERAGE CONTAINER

(71) Applicant: Packaging Corporation of America, Lake Forest, IL (US)

(72) Inventor: Nicholas A. Philips, Sugar Grove, IL (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

(21) Appl. No.: 16/566,646

(22) Filed: Sep. 10, 2019

Related U.S. Application Data

(60) Provisional application No. 62/742,819, filed on Oct. 8, 2018.

(51) Int. Cl.

| | |
|---|---|
| ***B65D 77/06*** | (2006.01) |
| ***B65D 5/468*** | (2006.01) |
| ***B65D 5/06*** | (2006.01) |
| ***B65D 5/42*** | (2006.01) |
| ***B65D 5/02*** | (2006.01) |
| ***B65D 5/74*** | (2006.01) |

(52) U.S. Cl.
CPC ..... *B65D 77/068* (2013.01); *B65D 5/0227* (2013.01); *B65D 5/06* (2013.01); *B65D 5/4266* (2013.01); *B65D 5/4608* (2013.01); *B65D 5/746* (2013.01)

(58) Field of Classification Search
CPC ..... B65D 77/068; B65D 5/0227; B65D 5/06; B65D 5/4266; B65D 5/4608; B65D 5/746; B65D 77/065; B65D 77/0426; B67D 7/005; B67D 2001/0827; B67D 3/0051; B67D 3/0067
USPC ..... 229/117.15, 117.3, 117.35, 117.24, 229/117.13, 117.27, 117.14, 125.04; 222/105; 220/495.03, 495.05, 495.06
See application file for complete search history.

(56) References Cited

U.S. PATENT DOCUMENTS

| | | | |
|---|---|---|---|
| 181,014 | A | 8/1876 | Scott |
| 1,129,778 | A | 2/1915 | Baldwin |
| 1,892,714 | A | 1/1933 | Wellman |
| 1,984,611 | A | 12/1934 | Weaver |
| 2,413,721 | A | 1/1947 | Lobl |
| 2,574,931 | A | 11/1951 | Nason, Jr. |
| 2,618,409 | A | 11/1952 | Eisenberger et al. |
| 2,714,982 | A | 8/1955 | Strauss |
| 2,898,027 | A | 8/1959 | Scholle |
| 2,946,494 | A | 7/1960 | Kuss |
| 2,954,901 | A | 10/1960 | Winsted |
| 2,967,655 | A | 1/1961 | Seger, Jr. |
| 2,990,101 | A | 6/1961 | Mead et al. |

(Continued)

FOREIGN PATENT DOCUMENTS

| | | |
|---|---|---|
| EP | 0 273 102 A1 | 7/1987 |
| GB | 1529062 | 10/1978 |

(Continued)

*Primary Examiner* — Christopher R Demeree
(74) *Attorney, Agent, or Firm* — Klarquist Sparkman, LLP

(57) ABSTRACT

A beverage container can comprise a container housing for housing an internal liquid container. The container can include first and second shields extending from panel sections of the housing that interlock over the container. The shields can be spaced between a hand hold opening through a top portion of the container housing and the internal liquid container. A gap can be provided between the shields and hand hold opening.

26 Claims, 22 Drawing Sheets

(56) References Cited

U.S. PATENT DOCUMENTS 3,054,549 A 8/1962 Humphrey
3,090,526 A 5/1963 Hamilton et al.
3,119,543 A 1/1964 Walker
3,126,140 A 3/1964 Lizan et al.
3,132,789 A 5/1964 Forrest
3,140,811 A 7/1964 Hall et al.
3,143,249 A 8/1964 Merrill et al.
3,160,326 A 12/1964 Sturdevant et al.
3,163,544 A 12/1964 Valyi
3,169,690 A 2/1965 Scholle
3,173,579 A 3/1965 Curie et al.
3,186,625 A 6/1965 Mead et al.
3,204,825 A 9/1965 Underwood
3,227,322 A 1/1966 Crain
3,233,817 A 2/1966 Casady
3,349,986 A 10/1967 Chapman
3,362,574 A 1/1968 Asmus et al.
3,363,807 A 1/1968 Powell
3,373,917 A 3/1968 Cox
3,416,717 A 12/1968 Beck, Jr. et al.
3,416,719 A 12/1968 Pilger
3,426,955 A 2/1969 Olson
3,427,646 A 2/1969 Scholle
3,456,861 A 7/1969 Wettlen
3,463,357 A 8/1969 MacLean, Jr. et al.
3,482,758 A 12/1969 Pierre et al.
3,484,011 A 12/1969 Soper et al.
3,506,180 A 4/1970 Forrest
3,517,875 A 6/1970 Wakefield
3,521,807 A 7/1970 Weisberg
3,542,566 A 11/1970 Wakefield
3,547,660 A 12/1970 Weisberg
3,550,833 A 12/1970 Rahenkamp
3,567,104 A 3/1971 Arslanian
3,576,290 A 4/1971 Marchisen
3,580,465 A 5/1971 Davies
3,604,491 A 9/1971 Spiess
3,640,447 A 2/1972 Forbes, Jr. et al.
3,746,240 A 7/1973 Flynn
3,756,471 A 9/1973 Wissman
3,902,652 A 9/1975 Malcolm
3,907,169 A 9/1975 Gortz et al.
3,927,824 A 12/1975 Razziano
3,931,916 A 1/1976 Blue et al.
3,938,728 A 2/1976 Deards et al.
3,944,127 A 3/1976 Bruke et al.
3,952,940 A 4/1976 Malcolm
4,019,628 A 4/1977 Derby
4,076,147 A 2/1978 Schmit
4,109,822 A 8/1978 Egli
4,154,346 A 5/1979 Neuberger
4,172,152 A 10/1979 Carlisle
4,174,051 A 11/1979 Edwards et al.
4,184,608 A 1/1980 Christensson
4,197,962 A 4/1980 Edwards
4,209,092 A 6/1980 Jones
4,245,743 A 1/1981 Neuberger
4,266,698 A 5/1981 Rausing
4,304,353 A 12/1981 Stollberg
4,308,955 A 1/1982 Hanes
4,375,864 A 3/1983 Savage
4,401,239 A 8/1983 Thomassen
4,445,550 A 5/1984 Davis et al.
4,454,945 A 6/1984 Jabarin et al.
4,471,884 A 9/1984 Kuchenbecker
4,484,697 A 11/1984 Fry, Jr.
4,488,661 A 12/1984 Homma
4,524,883 A 6/1985 Herring
4,549,673 A 10/1985 Kupersmit
4,560,090 A 12/1985 Okushita
4,565,315 A 1/1986 Wagner et al.
4,572,422 A 2/1986 Neuberger et al.
4,623,075 A 11/1986 Riley
4,635,814 A 1/1987 Jones
4,653,671 A 3/1987 Duffy et al.
4,660,737 A 4/1987 Green et al.
4,673,125 A 6/1987 Weaver
4,696,840 A 9/1987 McCullough et al.
4,736,870 A 4/1988 Christensson
4,771,917 A 9/1988 Heaps et al.
4,781,314 A 11/1988 Schoonover et al.
4,786,192 A 11/1988 Graves et al.
4,815,631 A 3/1989 Eeg et al.
4,816,093 A 3/1989 Robbins, III
4,854,474 A 8/1989 Murray et al.
4,872,588 A 10/1989 Texidor
4,890,761 A 1/1990 Gaves
4,890,772 A 1/1990 Neuberger et al.
4,898,301 A 2/1990 Schick
4,927,037 A 5/1990 Boots
4,953,739 A 9/1990 Wooge et al.
4,968,624 A 11/1990 Bacehowski et al.
5,042,682 A 8/1991 Ritter et al.
5,048,691 A 9/1991 Heuberger et al.
5,050,775 A 9/1991 Marquardt
5,054,644 A 10/1991 Greenslade
5,074,429 A 12/1991 Komel et al.
5,092,486 A 3/1992 vom Hofe et al.
5,106,015 A 4/1992 Vlasaty et al.
5,125,566 A 6/1992 Deiger
5,147,062 A 9/1992 Heuberger et al.
5,147,071 A 9/1992 Rutter et al.
5,156,294 A 10/1992 Nichols
5,156,295 A 10/1992 Gordon et al.
5,163,485 A 11/1992 Hermann
5,169,019 A 12/1992 Budenbender
5,197,625 A 3/1993 Mullaney
5,199,594 A 4/1993 Obara et al.
5,201,462 A 4/1993 Sada et al.
5,203,470 A 4/1993 Brown
5,211,305 A 5/1993 Horton
5,246,162 A 9/1993 Heuberger et al.
5,259,550 A 11/1993 Kuchenbecker
5,265,753 A 11/1993 Moorman
5,275,332 A 1/1994 Heuberger et al.
5,314,088 A 5/1994 Heuberger et al.
5,356,022 A 10/1994 Tipps
5,392,958 A 2/1995 Kurtzahn et al.
5,427,267 A 6/1995 Willman
5,462,169 A 10/1995 Dygert et al.
5,482,179 A 1/1996 Bruhn
5,484,077 A 1/1996 Albanesi et al.
5,562,227 A 10/1996 Takezawa et al.
5,562,228 A 10/1996 Ericson
5,627,150 A 5/1997 Peterson et al.
5,715,992 A 2/1998 Andrews, Sr. et al.
5,749,489 A 5/1998 Benner et al.
5,750,216 A 5/1998 Horino et al.
5,769,273 A 6/1998 Sasaki et al.
5,788,121 A 8/1998 Sasaki et al.
5,794,811 A 8/1998 Walsh
5,794,812 A 8/1998 Walsh
5,799,818 A 9/1998 Ringer
5,803,302 A 9/1998 Sato et al.
5,829,637 A 11/1998 Takemura et al.
5,857,614 A 1/1999 Walsh
5,897,050 A 4/1999 Barnes
5,909,841 A 6/1999 Andrews, Sr. et al.
5,918,799 A 7/1999 Walsh
6,053,401 A 4/2000 Andrews, Sr.
6,062,431 A 5/2000 Geshay
6,062,467 A 5/2000 Ours et al.
6,102,568 A 8/2000 Davis
6,105,821 A 8/2000 Christine et al.
6,116,499 A 9/2000 Todjar-Hengami
6,139,187 A 10/2000 Galomb et al.
6,145,736 A 11/2000 Ours et al.
6,155,479 A 12/2000 Wellner et al.
6,164,526 A 12/2000 Dalvey
6,182,887 B1 2/2001 Ljunstrom et al.
6,196,452 B1 3/2001 Andrews, Sr. et al.
6,206,279 B1 3/2001 Countee
6,209,781 B1 * 4/2001 Sylvester ..... B65D 5/029
222/105

(56) References Cited

U.S. PATENT DOCUMENTS

| | | | | |
|---|---|---|---|---|
| 6,213,388 | B1 | 4/2001 | Ours et al. | |
| 6,223,981 | B1 | 5/2001 | Gunder | |
| 6,227,440 | B1 | 5/2001 | Hart | |
| 6,227,441 | B1 | 5/2001 | Sagel et al. | |
| 6,228,011 | B1 * | 5/2001 | Takemura | B65D 5/603 220/495.03 |
| 6,237,841 | B1 | 5/2001 | Tsutsui | |
| 6,253,993 | B1 | 7/2001 | Lloyd et al. | |
| 6,237,332 | B1 | 8/2001 | Todjar-Hengami | |
| 6,273,332 | B1 | 8/2001 | Todjar-Hengami | |
| 6,290,124 | B2 | 9/2001 | Andrews, Sr. et al. | |
| 6,318,626 | B1 | 11/2001 | St. Pierre et al. | |
| 6,360,942 | B2 | 3/2002 | Todjar Hengami | |
| 6,386,438 | B1 | 5/2002 | Walsh et al. | |
| 6,416,221 | B2 | 7/2002 | Price | |
| 6,435,402 | B1 | 8/2002 | Hengami | |
| 6,443,329 | B1 | 9/2002 | Rochefort et al. | |
| 6,474,040 | B1 | 11/2002 | Ours et al. | |
| 6,519,436 | B2 | 2/2003 | Katsuyama | |
| 6,637,623 | B2 | 10/2003 | Muise et al. | |
| 6,648,218 | B2 | 11/2003 | Katsuyama et al. | |
| RE38,377 | E | 1/2004 | Geshay | |
| 6,736,289 | B2 | 5/2004 | Cook et al. | |
| 6,755,324 | B2 | 6/2004 | Geshay | |
| 6,889,892 | B2 | 5/2005 | Walsh et al. | |
| 7,036,714 | B2 | 5/2006 | Walsh et al. | |
| 7,040,528 | B2 | 5/2006 | Hengami | |
| 7,066,869 | B2 | 6/2006 | Cook et al. | |
| 7,077,309 | B2 | 7/2006 | Andrews, Sr. | |
| 7,090,115 | B2 | 8/2006 | Pierce | |
| 7,097,092 | B1 | 8/2006 | Marrale | |
| 7,150,377 | B2 | 12/2006 | Cook et al. | |
| 7,210,612 | B2 | 5/2007 | Walsh et al. | |
| 7,350,670 | B2 | 4/2008 | Steeves et al. | |
| 7,377,420 | B2 | 5/2008 | Gardner | |
| 7,389,909 | B2 | 6/2008 | Crosland et al. | |
| 7,621,439 | B2 | 11/2009 | McClure | |
| 7,721,774 | B2 | 5/2010 | Cook et al. | |
| 7,770,756 | B2 | 8/2010 | Cook et al. | |
| 7,883,000 | B2 | 2/2011 | Sheffield et al. | |
| 8,056,763 | B2 | 11/2011 | Cook et al. | |
| 8,627,999 | B2 | 6/2014 | Wolf et al. | |
| 8,939,351 | B2 * | 1/2015 | Goudreau | B65D 77/065 229/117.3 |
| 8,950,657 | B2 | 2/2015 | Wagner | |
| 9,102,440 | B2 | 8/2015 | Cook et al. | |
| D772,054 | S | 11/2016 | Wolf | |
| D785,448 | S | 5/2017 | Wolf | |
| 9,643,749 | B2 | 5/2017 | Wagner | |
| 9,751,656 | B2 | 9/2017 | Wolf | |
| 10,118,751 | B2 | 11/2018 | Couvillon et al. | |
| 2001/0004994 | A1 | 6/2001 | Andrews, Sr. et al. | |
| 2002/0047040 | A1 | 4/2002 | Andrews, Sr. et al. | |
| 2002/0060240 | A1 | 5/2002 | Walsh et al. | |
| 2003/0024950 | A1 | 2/2003 | Yoneyama et al. | |
| 2003/0059130 | A1 | 3/2003 | Yoneyama et al. | |
| 2003/0134059 | A1 | 7/2003 | Andrews, Sr. et al. | |
| 2003/0136819 | A1 | 7/2003 | Walsh et al. | |
| 2003/0168501 | A1 | 9/2003 | Hengami | |
| 2004/0188504 | A1 | 9/2004 | Pierce | |
| 2005/0127150 | A1 | 6/2005 | Walsh et al. | |
| 2005/0133578 | A1 | 6/2005 | Farha et al. | |
| 2005/0211754 | A1 | 9/2005 | Fulcher | |
| 2005/0224564 | A1 | 10/2005 | Walsh | |
| 2005/0269388 | A1 | 12/2005 | Eguizabal | |
| 2006/0112717 | A1 | 6/2006 | Walton | |
| 2006/0144910 | A1 | 7/2006 | Wachter | |
| 2006/0180643 | A1 | 8/2006 | Stephenson | |
| 2006/0202003 | A9 | 9/2006 | Walsh et al. | |
| 2006/0202004 | A1 | 9/2006 | Holt | |
| 2006/0202005 | A1 | 9/2006 | Andrews, Sr. et al. | |
| 2006/0243783 | A1 | 11/2006 | Spivey, Sr. et al. | |
| 2006/0266810 | A1 | 11/2006 | Foushee | |
| 2006/0273142 | A1 | 12/2006 | Pierce | |
| 2007/0095881 | A1 | 5/2007 | Manaige | |
| 2007/0119914 | A1 | 5/2007 | Mestre et al. | |
| 2007/0164092 | A1 | 7/2007 | Biundo | |
| 2007/0187471 | A1 | 8/2007 | Ford | |
| 2007/0221714 | A1 | 9/2007 | Ours | |
| 2007/0228121 | A1 | 10/2007 | McKenna et al. | |
| 2007/0228122 | A1 | 10/2007 | McKenna et al. | |
| 2007/0228123 | A1 | 10/2007 | McKenna et al. | |
| 2007/0228127 | A1 | 10/2007 | Gardner | |
| 2008/0083777 | A1 | 4/2008 | Lips | |
| 2008/0086102 | A1 | 4/2008 | Coats et al. | |
| 2008/0087713 | A1 | 4/2008 | Deniston et al. | |
| 2008/0099541 | A1 | 5/2008 | Smith et al. | |
| 2008/0245848 | A1 | 10/2008 | Plunkett et al. | |
| 2008/0264970 | A1 | 10/2008 | Kasai | |
| 2008/0265009 | A1 | 10/2008 | Katoh | |
| 2008/0308616 | A1 | 12/2008 | Phung | |
| 2009/0050682 | A1 | 2/2009 | Cole et al. | |
| 2009/0084834 | A1 | 4/2009 | Duyst | |
| 2009/0101699 | A1 | 4/2009 | Goudreau et al. | |
| 2020/0115131 | A1 * | 4/2020 | Adams | B65D 77/067 |

FOREIGN PATENT DOCUMENTS

| | | |
|---|---|---|
| JP | 9 286 458 A | 11/1997 |
| WO | WO 93/11050 | 6/1993 |

* cited by examiner

LIQUID BEVERAGE CONTAINER

CROSS REFERENCE TO RELATED APPLICATION

This application claims the benefit of U.S. Provisional Application Ser. No. 62/742,819, entitled LIQUID BEVERAGE CONTAINER, filed on Oct. 8, 2018, which is incorporated by reference herein.

TECHNICAL FIELD

This disclosure relates to beverage containers and more desirably to such as beverage containers that house an internal liquid container with a spout for containing beverages inside the container.

BACKGROUND

Although a number of beverage containers are known to exist that have internal beverage containers, such as flexible liquid containing bags, therein for containing a beverage within the container, these known beverage containers suffer from one or more disadvantages.

SUMMARY

The beverage container as disclosed herein, depending upon its configuration, provides one or more of the following advantages/distinguishing features in comparison to known beverage containers.

A. The design provides a significant reduction in material utilized to manufacture the container, such as a reduction in the quantity of paperboard having one or more paper sheets with a fluted core therebetween required to make a container of a given size. For example, for a given equivalent fluid ounce capacity container, such as one sized to receive an internal 112 fluid ounce beverage container, the amount of paperboard utilized to construct the beverage container is reduced by 18-20% in comparison to beverage containers known to the inventor, while still achieving the desirable functions.

B. The ability to more easily see beverage contents as they are dispensed from the container into another vessel; such as dispensing coffee, hot chocolate or cider into a cup. This advantage is in part is due to features retaining a spout on a sloped shoulder portion of a front wall of the container; and also by employing a handhold grip for a user that facilitates a more natural wrist angle of a user that makes the spout more visible to the user when the beverage is dispensed.

C. A durable handle feature that is very comfortable and easy to use. In one specific form, the handle comprises an opening through the top of the container through which fingers of the user's hand, such as all of the fingers of the user's hand can be inserted. Desirably the hand receiving opening is reinforced, such as by a double layer of paper board through overlaying top panel sections of the container. The outer top panel section can have a flap that folds into the opening to provide further reinforcement, especially if the user's fingers are wrapped around the in folded flap during pouring. Thus, by providing a hand opening through the top of the container, such as through two top flaps or top panel sections of the container, a user has greater control during single-handed pouring of beverages. That is, a significant portion of the user's hand can grasp the container during such pouring.

D. Interlocking first and second interior shield flaps or shield panel sections positioned below the handle opening that are positioned to shield the interior liquid container from the opening. The shield flaps provide thermal insulation between the beverage (e.g. hot coffee) in the interior container and the inserted user's hand. The interior flaps are desirably constructed to automatically be spaced below the top panel sections of the container when interconnected to provide a gap or headspace between the top of the container and the shield panel sections that readily accommodates the insertion of the user's hand through the opening in the top panel sections and into the container. The heat shield flaps desirably project inwardly from upper end portions of opposed first and second side wall panels sections, and more desirably (due to a reduction of material usage) from opposed front and rear wall panel sections of the beverage container.

E. Desirably the container has opposed first and second side wall panel sections that each have a respective upper inwardly sloped shoulder panel section that partially overlies the interior container. The container also desirably has respective opposed front and rear wall panel sections.

The front wall panel section desirably has an upwardly and inwardly sloped front wall shoulder panel section that partially overlies the interior container with a spout receiving opening extending through the front wall shoulder panel section. The term "opening" in this disclosure includes both a void and an opening closed by readily removable material, such as paper board with a tear line, such as formed by cuts or perforations bounding the opening. The rear wall panel section desirably has an upwardly and inwardly sloped rear wall shoulder panel section that partially overlies the interior container. The rear wall panel section can less desirably be vertical instead of inwardly sloped.

The shield panel sections desirably extend or project inwardly from the upper ends of either the opposed first and second side wall shoulder panel sections or from the upper ends of the opposed front and rear shoulder panel sections, and most desirably from the opposed upper ends of the opposed front and rear panel sections.

First and second top panel sections are desirably provided and desirably extend or project inwardly from the upper ends of the opposed shoulder panel sections other than those from which the shield panel sections extend.

Most desirably the shield panel sections project inwardly from the upper ends of the respective front and rear shoulder (or from the upper end of the rear wall panel if the rear wall panel lacks an inwardly sloped rear wall panel section).

The slopes of the shoulder panel sections can be the same, such as greater than forty-five degrees, or they can be different.

A first inner top panel section can extend or project inwardly from the upper end of the first side wall panel shoulder section, and a second outer top panel section can extend or project inwardly from the upper end of the second side wall panel section and can overlie the first top panel section. The first and second top panel sections close the top of the container and desirably each substantially spans the entire distance between the upper ends of the first and second side wall panel shoulder sections.

A slot can be provided in the inner top panel section, or at the intersection of the inner top panel section and the second side wall panel section to receive a locking tab or flap of the second top panel section to retain the top panel sections closed.

The second top panel section can comprise a spout engaging flap that over lies and abuts the exterior surface of the front shoulder panel section with an opening that at least partially surrounds the neck of the spout to provide additional reinforcement to the spout and assist in retaining the spout in place during use of the container. This construction in effect provides a double-thickness spout holder around a major portion of the perimeter of the neck of the spout.

F. An inwardly foldable first web can be provided between the front side wall panel section and the first side wall shoulder panel section and a second inwardly foldable web can be provided between the front side wall shoulder panel section and the second side wall shoulder panel section. In addition, if the rear wall panel section includes a rear wall panel shoulder panel section, a third inwardly foldable web can be provided between the rear side wall shoulder panel section and the first side wall shoulder panel section and a fourth inwardly foldable web can be provided between the rear side wall shoulder panel section and the second side wall shoulder panel section. In a desirable construction, the first web can comprise first and second triangular shaped portions or darts; one side of the first dart being joined or coupled at a fold line to a side edge of the front wall shoulder portion and the second dart being joined or coupled at a fold line to side edge of the first side wall shoulder portion; and adjacent side edges of the first and second darts being joined or coupled together along a fold line that is desirably aligned with the intersection of the front wall panel section and the first side wall panel section. In this construction, the second web can be the same as the first web. For example, the second web can comprise third and fourth triangularly shaped portions or darts that are like the first and second portions or darts; one side of the third dart being joined or coupled at a fold line to a side edge of the front wall shoulder portion opposite to the side edge to which the first dart is joined or coupled; the fourth dart being joined or coupled at a fold line to side edge of the second side wall shoulder portion; and adjacent side edges of the third and fourth darts being joined or coupled together along a fold line that is desirably aligned with the intersection of the front wall panel section and the second side wall panel section. In addition, in this construction, the third web can comprise a triangularly shaped portion or dart having a first side edge joined or coupled to the first side wall panel by a fold line that is desirably aligned with the intersection of the rear wall panel section and the first side wall panel section. Also, in this construction, the fourth web can comprise a triangularly shaped portion or dart having a first side edge joined or coupled to the second side wall panel by a fold line that is desirably aligned with the intersection of the rear wall panel section and the second side wall panel section. All of the darts can be right triangles with their respective apexes pointing toward the bottom of the container. Also, the first and second webs can be isosceles triangularly shaped with their respective apexes pointed toward the bottom of the container.

G. As the shield panel sections are joined together, this causes the webs to fold inwardly. This speeds up the erection of the container from a collapsed flattened shipping state to an erected state during use by moving and holding contoured shoulder forming webs of the container in an inward position as the first and second top panel sections are positioned.

H. Additional two-handed beverage pouring control is offered by embodiments that provide a tip-assist grip area or overhang at the back of the container and opposite to the spout. The overhang can easily be grasped by a user's second hand while the user's first hand is in the handle opening. The overhand or eave portion can be used to assist in tipping the container forwardly and downwardly while the first hand is handhold.

I. The container as described herein has an extremely pleasing, refined and aesthetic look. The described utilitarian features of the container are achievable with containers having a different appearance. The spout is not part of the aesthetic design.

J. In a desirable form, the wall panel sections of the container are of the same height and the top panel is horizontal, and parallel to the bottom of the container. In the absence of protruding handle sections, such as extending upwardly from the top panel sections, a container with parallel top and bottom surfaces facilitates stable stacking of additional items on top of the container, such as a delivery tray, large bag or catering box. In a less desirable form, the rear wall panel section can be shorter than the front wall panel section, in which case the top panels would be inclined upwardly along at least a portion of the length of the container.

In addition, in accordance with an embodiment, a spout receiving opening is provided in a shoulder portion of a front wall of the container and a top panel section includes a spout engaging flap that folds over the shoulder section and engages the spout to provide a double-thickness spout holder around a major portion of the perimeter of the spout.

K. Desirably the container is made from a one piece unitary blank of paper board material.

L. The bottom can be formed of bottom panel sections or flaps, a respective one of which is joined or coupled to the lower edge of each panel section by a fold line. The bottom panel sections and rear wall panel section and second sidewall panel section are secured together, such as by adhesive. In a pre-erected state, the first wall panel section and front side wall panel section can overlay the rear side wall section and second wall panel section with the bottom panel flaps folded and positioned therebetween to provide a flattened container such as for shipment and storage. When erected, the bottom panel sections desirably unfold to form the bottom of the container as the wall panel sections are spread apart. The other components of the container are easily manipulated into position to form the container.

M. This disclosure encompasses the container itself that houses the internal beverage holder as well as the container in combination with the internal beverage holder.

These and other features and advantages of the disclosed designs will become more apparent from the detailed description below.

DESCRIPTION OF THE FIGURES

In FIG. 7 the spout has been omitted for convenience.

FIG. 16 shows the container partially erected with the bottom assembled as shown in FIG. 13.

FIG. 17 illustrates exemplary inner shield panel sections folded inwardly and interlocked.

FIG. 18 illustrates folding of two of the corner webs, the other corner webs not being visible in this FIG. 18.

FIG. 19, shows an inner top panel section being folded inwardly over the shield panel sections.

FIG. 20 shows the inner top panel in a folded in position.

FIG. 21 illustrates an outer top panel folded to its erected position with a locking tab inserted into a locking slot. In addition, FIG. 21 illustrates a top front flap folded down to a position where it would engage the spout if the spout were included in FIG. 21.

FIG. 22 is like FIG. 21 except that the spout is included and the top front flap is shown with an additional fold positioned above the spout.

DETAILED DESCRIPTION

Features and advantages of containers in accordance with this disclosure will become more apparent from the following detailed description, which proceeds with reference to the accompanying drawings. A container need not have all of the features or provide all of the advantages disclosed here to be encompassed within the invention of this disclosure. The invention includes all novel and non-obvious combinations and sub-combinations of the container features set forth herein.

Throughout this disclosure, when a reference is made to a first element being coupled to a second element, the term "coupled" is to be construed to mean both direct connection of the elements as well as indirect connection of the elements by way of one or more additional intervening elements. Also, the singular terms "a", "an", and "first", mean both the singular and the plural unless the term is qualified to expressly indicate that it only refers to a singular element, such as by using the phase "only one". Thus, for example, if two of an element are present, there is also "a" or "an" of such element that is present. In addition, the term "and/or" when used in this document is to be construed to include the conjunctive "and", the disjunctive "or", and both "and" and "or". Also, the terms "includes" and "has" have the same meaning as "comprises". Also, the terms "including" and "having" have the same meaning as "comprising". The terms "about" and "substantially" means within plus or minus five percent of the stated value or term.

Figure 1:
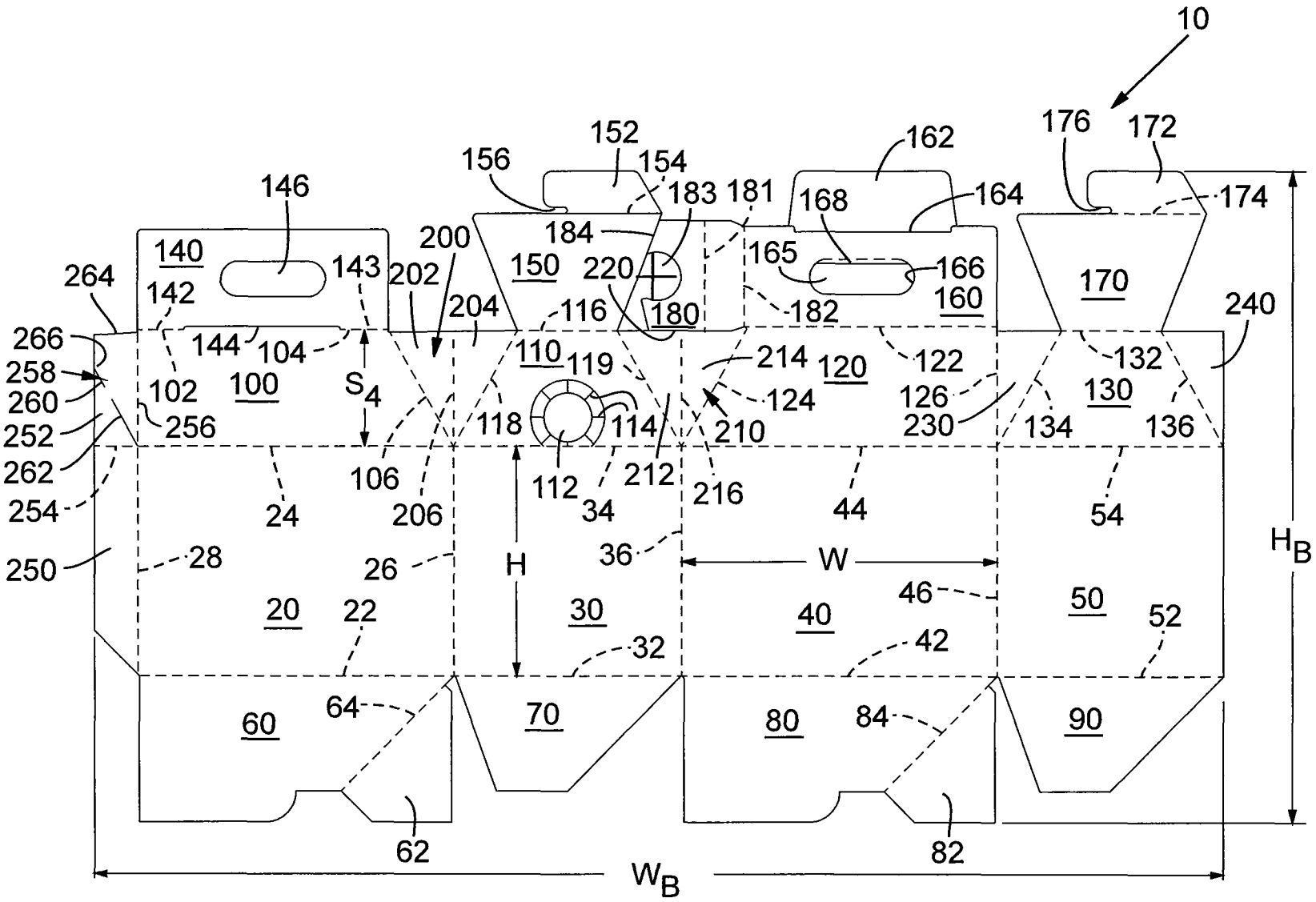
FIG. 1 is a plan view of an embodiment of a blank that can be used to form the container of FIG. 21; and with the optional fold line 181, the container of FIG. 22.

With reference to FIG. 1, a blank 10 is shown for forming a container within which a liquid container with a spout, such as a flexible spouted bag is positioned to hold beverages within the container. The illustrated container can be made of a variety of materials. However, a particularly desirable material is corrugated paperboard having one or more face sheets with a corrugated or fluted layer therebetween. For reasons of enhancing the vertical strength of the container, desirably the flutes or corrugations are in a vertical direction (from the bottom to the top) of the blank shown in FIG. 1. Desirably, the blank comprises a one piece unitary blank. Less desirably, components included in the illustrated blank can be separate pieces that are interconnected to form the blank.

The illustrated blank 10 comprises a plurality of coupled together side wall portions or panel sections. In the form shown, the blank has four such side wall panel sections. The illustrated side wall panel sections comprise a first side wall panel section 20, a front wall panel section 30, a second side wall panel section 40 and a rear side wall section 50. In addition, the container comprises a plurality of bottom forming flaps that form the bottom of the container. In the illustrated embodiment, although other configurations are possible and fewer flaps can be used, there are four such bottom forming flaps, one being coupled to the lower edge of each of the wall sections described above.

More specifically, the illustrated bottom forming flaps include flaps 60, 70, 80 and 90. The flap 60 is joined or coupled to a lower edge 28 of the first side wall panel section 20 by a fold line. The fold lines described herein can be formed in any suitable manner such as by weakening the paperboard material at the location by perforations, slits or more desirably a crease. The bottom flap 70 is joined or coupled to the front wall panel section 30 by a fold line 32, the bottom flap 80 is joined or coupled to the lower edge 42 of the panel section 40 by a fold line and the bottom flap 90 is joined or coupled to the lower edge 52 of rear panel section 50 by a fold line.

Panel section 60 comprises a glue section 62 to which adhesive is applied (more specifically to the interior surface thereof) for gluing the bottom panel flap 60 to the outer or exterior surface of bottom forming flap 70. In addition, the bottom forming flap 82 has a glue section 82 to which adhesive is applied to the interior surface thereof for securing the section 82 to the outer or exterior surface of the bottom flap 90. A fold line 64 is positioned between the section 62 and the remaining portions of the bottom flap 60. The fold line in the illustrated embodiment is formed by a plurality of cuts through the paperboard. In addition, similarly, a fold line 84, which can be like the fold line 64, is positioned between the section 82 and the remaining portions of the bottom flap 80. The fold lines 64 and 84 allow the bottom flaps of the container to be secured together and folded for shipment and unfolded during erection of the container as explained below.

The illustrated container comprises a plurality of shoulder panel forming sections 100, 110, 120 and 130. Shoulder panel section 100 is joined or coupled to the upper edge 24 of the first side wall panel section 20 by a fold line; front shoulder panel section 110 is joined or coupled to the front side wall 130 by a fold line along the upper edge 34 of the front side wall section; shoulder panel section 120 is joined or coupled to the upper edge 44 of the second side wall panel section 40 by a fold line; and the rear shoulder wall panel section 130 is joined or coupled to the upper edge 54 of the rear wall panel section 50 by a fold line.

The front shoulder panel section 110 includes a spout receiving opening 112 which is desirably circular or otherwise of a cross section that is desirably shaped like the cross section of the spout to be inserted therethrough. The cross-sectional area of the opening 112 is desirably less that the cross-sectional area of the spout, but desirably about the cross-sectional area and shape of a neck of the spout. Radially outwardly extending slits, two of which are numbered 114 in FIG. 1, are spaced about the periphery of the opening 112. These slits facilitate the insertion of the spout through the opening such that the spout projects outwardly from the shoulder section 110 and the neck of the spout is engaged by the portions of the front shoulder wall section that bounds the opening. The front shoulder wall section therefore, in this example, retains the spout in a desired position on the front side wall shoulder section 110 when the container is in use. Alternative spout retaining mechanisms can be used.

An inner top flap forming section 140 is joined or coupled by fold lines 142, 143 to upper edge portions 102, 104 of the first wall shoulder panel forming section 100. A slot 144 is provided between the fold lines 142, 143 for receiving a retention flange of an outer top forming flap section as explained below. A hand opening 146 is provided in the top flap section 140. Desirably the hand opening is sized large enough to permit two or more (and more desirably four) fingers of a user's hand to be inserted through the hand opening. The illustrated opening is an elongated oval shape, but other opening shapes can be used.

An outer top flap forming section 160 is joined or coupled by a fold line to an upper edge 122 of the second side wall shoulder panel section 120. The panel section 160 has a retaining flap or tab portion 162. The tab 162 is desirably foldable relative to the major portion of the top flap 160 about a fold line 164. When the container is assembled, the flap 162 is inserted into the slot 144 with the top flap portion 160 overlaying the inner top flap portion 140.

Figure 22:
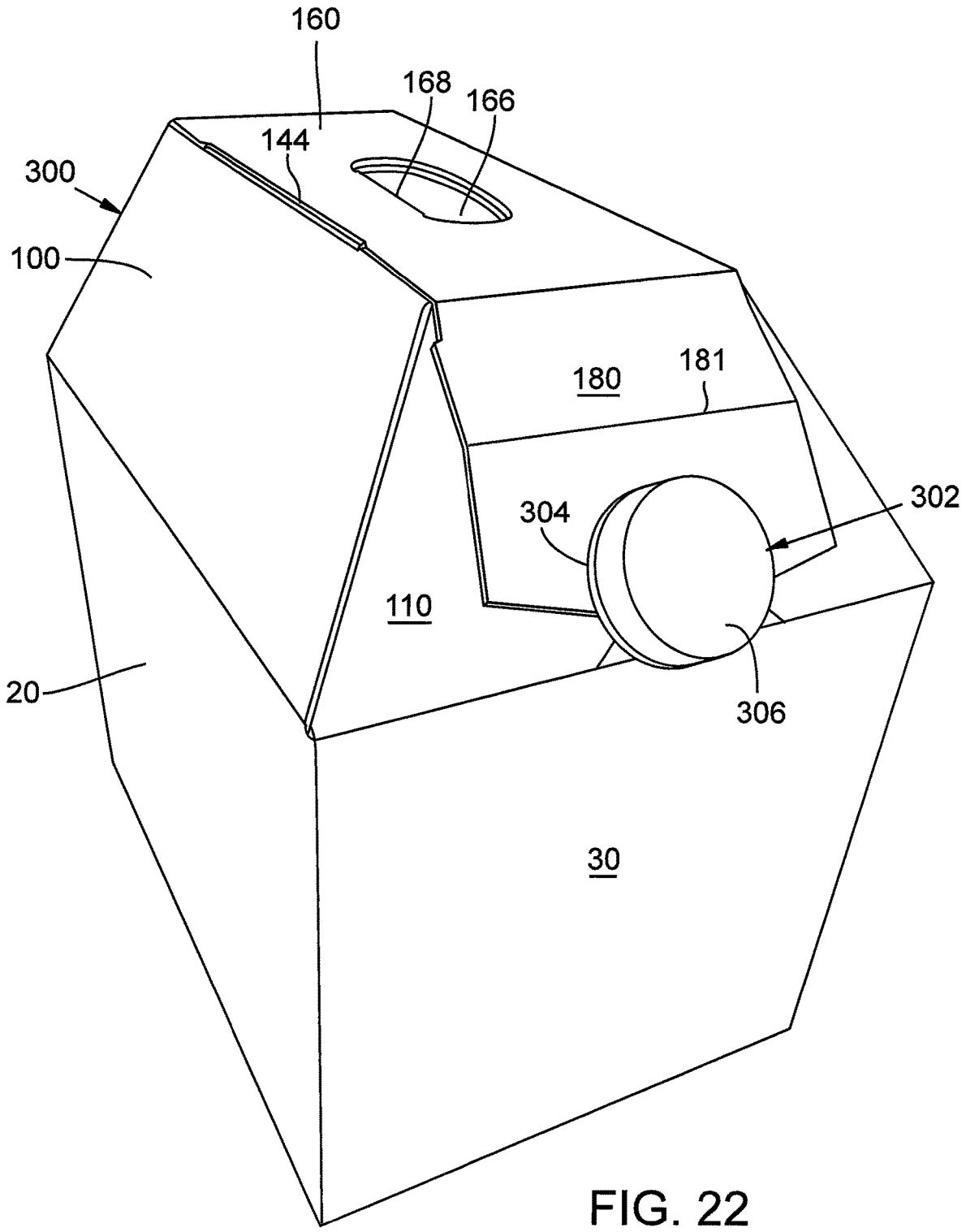

An oval shaped flap 165 is provided in the top panel 160. The oval shaped flap is joined or coupled to the top panel by a fold line 168 and overlays a hand hold opening 166. The shape of the flap 165 and opening 166 can be changed such as to match the shape of the opening 146. Less desirably, handle sections can extend upwardly from the top panel sections at the cost to the advantages of the described hand hold opening structure. When the container is assembled, the opening 166 is aligned and overlays the opening 146 and the flap 165 is folded downwardly through the opening 146 to assist in interlocking the top panel forming sections 140, 160 of the container. An optional spout engaging flap 180 can be joined or coupled by a fold line to an end edge 182 of the outer top flap forming panel section 160. The flap 180 has a cutout or opening in the form of a portion of a circle, desirably greater than 180 degrees, the cutout being indicated at 183 in FIG. 1. The flap 180 is separated from the panel section 160 by a cut line 184. When the container is assembled, the flap 180 overlays the front shoulder panel section 110 and engages the neck of the spout where the neck projects outwardly through the opening 112 with the interior surface of the flap 180 abutting the exterior surface of the front shoulder panel section 110. The flap 180 is optional but desirable as it does provide a dual walls thickness engaging surface for the spout when combined with the opening 112. In an embodiment with the optional fold line and fold 181 as shown in the blank of FIG. 1, an embodiment of the assembled container will appear as in FIG. 22 with the fold 181 positioned above the spout. This optional fold 181 makes the assembly of the container faster and easier as the fold 181 facilitates positioning the top panel spout lock 183 into engagement with the spout after the top flap portion 160 is locked in position over the inner top flap portion 140 by the insertion of the retaining flap 162 into the slot 144.

A first inner shield flap or panel portion 150 is joined or coupled to an upper edge 116 of the front shoulder panel section 110 by a fold line. The panel section 150 can be of a variety of shapes. However, in the illustrated example the panel section 150 is trapezoidal in shape. An interlocking flange 152 is joined or coupled by a fold line 154 to the heat shield panel section 150. The flange 152 has an inwardly extending second shield panel flap engaging recess 156.

A second inner shield flap or panel portion 170 is joined to an upper edge 132 of the rear wall shoulder panel section 130. Like the panel section 150, the panel section 170 comprises an inner engaging flange portion 172 joined by a fold line 174 to the panel section 170. The flange portion 172 has an inwardly extending first shield flap engaging recess 176. The flanges 152, 172 are interlocked to join them together. Although alternative interlocking mechanisms can be used, in the illustrated example, the flanges 152, 172 engage one another by positioning a portion of the flange 152 in the locking recess 176 and a portion of the flange 172 in the locking recess 156. When interlocked the shield panel sections of flaps 150, 170 are coupled together (when the container is erected). The interlocked shield panel sections 150, 170 are positioned below the inner and outer top flap portions 140, 160 in the erected container and desirably spaced from the top panel sections to provide a gap or head space between the top panel sections 140, 160 for insertion of a user's hand through the openings 168, 146 when the assembled container is grasped.

The shield panel sections 150, 170 overlay a beverage container in the container and are positioned between the hand hold openings (146, 166) through the top panel flaps 140, 160. The shield panel sections provide thermal insulation and desirably prevent the users hand from touching an internal liquid container, which may contain a hot beverage such as coffee, positioned beneath the top panel sections 140, 160.

An inwardly foldable first web 200 can be provided between the front shoulder wall panel section 110 and the first side wall shoulder panel section 100 and a second inwardly foldable web 210 can be provided between the front side wall shoulder panel section 110 and the second side wall shoulder panel section 120. In addition, if the rear wall panel section includes a rear wall panel shoulder panel section 130, a third inwardly foldable web 240 can be provided between the rear side wall shoulder panel section 130 and the first side wall shoulder panel section 100 and a fourth inwardly foldable web 230 can be provided between the rear side wall shoulder panel section 130 and the second side wall shoulder panel section 120. In a desirable construction, the first web can comprise first and second triangular shaped portions or darts 204, 202; one side of the first dart 204 being joined or coupled at a fold line to a side edge 118 of the front wall shoulder portion and the second dart 202 being joined or coupled at a fold line 206, in this example formed by spaced apart cuts, to side edge 106 of the first side wall shoulder portion; and adjacent side edges of the first and second darts being joined or coupled together along a fold line 206 that is desirably aligned with the intersection 26 of the front wall panel section 30 and the first side wall panel section 20. In this construction, the second web 210 can be the same as the first web 200. For example, the second web can comprise third and fourth triangularly shaped portions or darts 212, 214 that can be like the first and second portions or darts 204, 202; one side of the third dart 212 being joined or coupled at a fold line to a side edge 119 of the front wall shoulder portion 110 opposite to the side edge 118 to which the first dart 204 is joined or coupled; the fourth dart being joined or coupled at a fold line to side edge 124 of the second side wall shoulder panel section 120; and adjacent side edges of the third and fourth darts being joined or coupled together along a fold line 216, in this example formed by spaced apart cuts, that is desirably aligned with the intersection 36 of the front wall panel section and the second side wall panel section. In addition, in this construction, the third web 240 can comprise a triangularly shaped portion or dart having a first side edge joined or coupled to the first side wall shoulder panel section 100 by a fold line that is desirably aligned with the intersection 28 of the rear wall panel section 50 and the first side wall panel section 20. In addition, the third web is joined or coupled to the rear shoulder panel section 130 along a fold line 136. Also, in this construction, the fourth web 230 can comprise a triangularly shaped portion or dart having a first side edge joined or coupled to the second shoulder panel section by a fold line (at 126) that is desirably aligned with the intersection of the rear wall panel section 50 and the second side wall panel section 40. In addition, the fourth web 230 is joined or coupled to the edge 134 of the rear shoulder panel section 120 along a fold line. All of the darts can be right triangles with their respective apexes pointing toward the bottom of the container. Also, the first and second webs 200, 210 can be isosceles triangles with their respective apexes pointed toward the bottom of the container.

In the illustrated embodiment, the edge 26 of the panel section 20 is joined or coupled to the panel section 30 by fold line; the edge 36 of the panel section 30 is joined or coupled to the panel section 40 by a fold line; and the edge 46 of the panel section 40 is joined or coupled to panel section 50 by a fold line. In addition, the edge 28 of panel section 20 opposite to the edge 26 is joined by a fold line to a glue tab 150. When the container is manufactured, the glue tab 250 is joined to the interior surface of the panel 50. In addition, the glue tab 250 is provided with an upper dart forming glue tab portion 252 with a fold line 254 positioned between the portions 252 and 250. In addition, the section 252 is joined or coupled to the first side wall shoulder panel section 100 by a fold line 256. In addition, an angular weakened line 258, comprising in this example first and second spaced apart cuts 260, 262 is provided in the dart forming panel section 252. The weakened line or cuts extending from the intersection of fold line 254 and edge 28 to an outer edge location 266 of the glue tab dart forming section 252 spaced below the upper edge 264 of the section 252. When the container is manufactured, the portion of section of 252 above the cut line 258 ends up secured, such as by adhesive, to the interior surface of the dart 240.

With this construction, when the container is erected, the web 200 and more specifically the darts 202, 204 thereof fold inwardly about the fold line 206; the web portion 210, and more specifically the darts 210, 212, fold inwardly about the fold line 216; the darts 230 and 240 fold inwardly about the respective fold lines 134 and 136 (and about the cut line 262). As these webs fold inwardly, the respective shoulder portions are inclined inwardly from the respective associated wall panels of the container. The slopes of the shoulder sections can be the same. Alternatively, the inward slopes can be different, such as by adjusting the shape of the darts or web portions. For example, the slope of the rear wall shoulder panel section can be made different than the slope of the front wall shoulder panel section. Although less desirable, the darts 230, 240 can be eliminated such that the rear wall is vertical and without an inwardly and upwardly sloping rear wall shoulder panel portion. However, with the darts in the rear wall, the top panel sections 140, 160 overhang the inwardly and upwardly sloping rear wall shoulder panel section to form an eave over the rear shoulder panel section. This eave or overhang provides a location for a user's hand to grip and tip the container, for example while the user's other hand is in the hand hold formed by the openings 146, 166. As yet another less desirable alternative, the darts can be configured to make the rear wall shoulder portion slope upwardly and outwardly to increase the size of the eave.

Desirably, the top wall edges lines 24, 34, 44 and 54 and associated fold lines between the wall panel sections 20, 30, 40, 50 and shoulder sections 100, 110, 120, 130 are in a first line and the bottom wall edges 22, 32, 42 and 52 and associated fold lines between the wall panels and the bottom flaps 60, 70, 70, 90 are in a second line parallel to the first line. With this construction, the height (H) of all of the wall panel sections 20, 30, 40 and 50 are the same. In addition, the height (SH) of each of the shoulder sections 100, 110, 120 and 130 can be made the same. In addition, the fold lines 142, 143, 116, 122 and 132 can be in a third line. With this construction, when the container is assembled, the top flaps 140, 160 will be parallel to the fold lines 22, 32, 42 and 52 and thereby to the bottom of the container. Alternatively, and less desirably, the rear wall can be made shorter than the front wall.

It should be noted that the slope of the shoulder portions can be varied but desirably are at an acute angle relative to the respective first and second side walls and front and rear wall panel sections. Desirably the inward and upward slope of the respective shoulder panel sections is greater than forty-five degrees relative to the side wall panels. In addition, in a desirable construction, the side wall sections and front and rear wall sections are perpendicular to the bottom of the container when the container is placed on a flat horizontal surface such as a table.

A blank as described above efficiently uses material to form the container. For a container for holding an internal beverage container, such as a bag that is sized to hold 112 ounces of liquid, the container can be constructed from a blank having an overall width $W_B$ of about thirty-two and one-half inches and an overall height $H_B$ of about eighteen and one-third inches.

With reference to the additional figures included in this disclosure, the same numbers as described above are indicated on these figures. As a result, the elements indicated by these numbers will not be discussed in detail.

Figure 2:
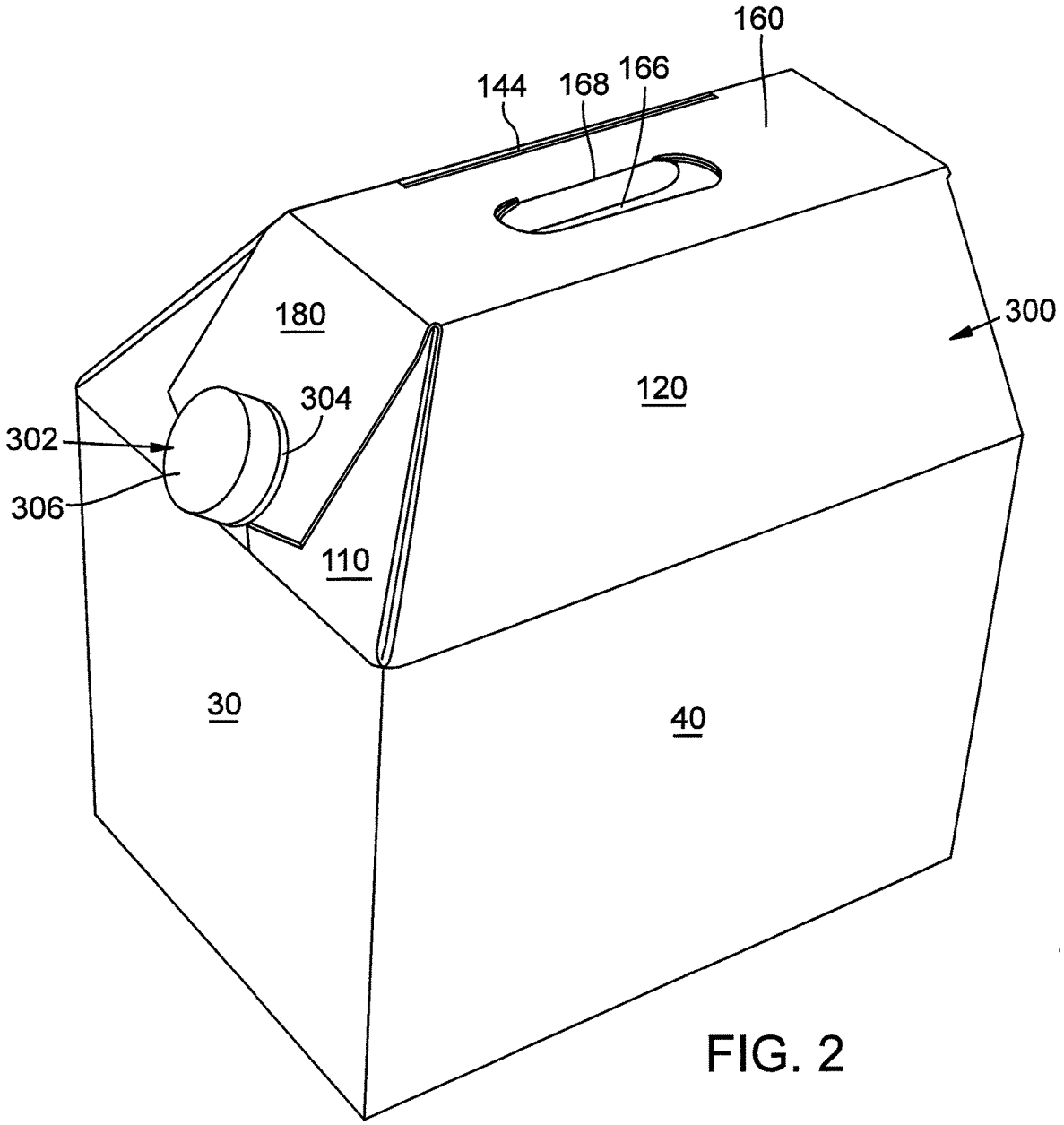
FIG. 2 is a perspective view of an embodiment of an erected container that can be formed from the blank of FIG. 1, looking toward the front and right side of the container.

FIG. 2 is a right perspective view of an erected container 300 formed from the blank 10 of FIG. 1. A spout 302 is shown of an internal liquid container is shown in this FIG. 2. A neck 304 of the spout 302 is inserted through the opening in front shoulder panel section 110 and through the opening in retaining flap 180. The shoulder panel section 110 and flap 180 assist in holding the spout in position on the container. The internal liquid container can be a flexible bag, and is desirably not fastened to the container, although it can be, such as by adhesive. The spout is also shown with a cap 306.

Figure 3:
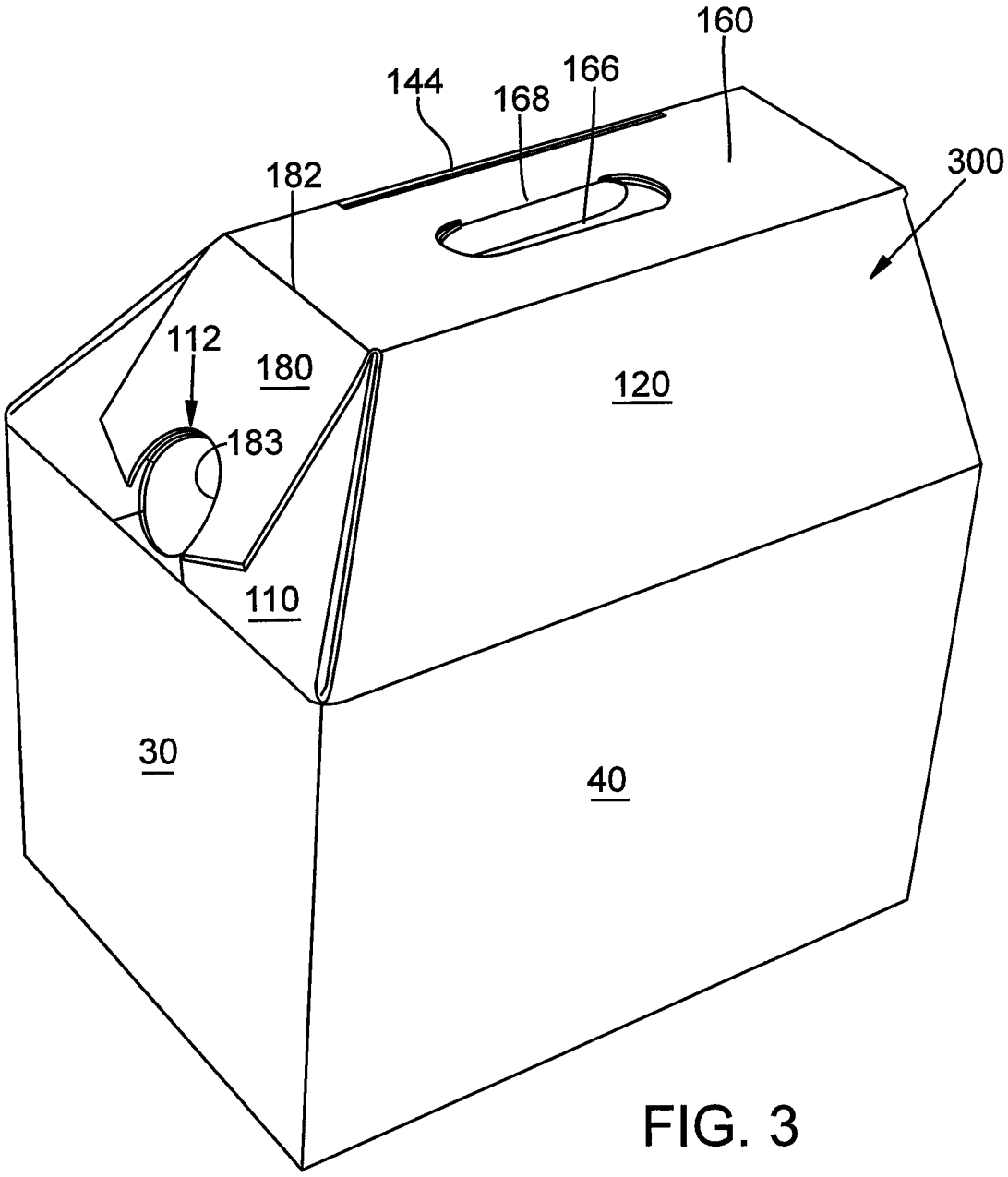
FIG. 3 is like FIG. 2 except that a spout is absent in FIG. 3 and the view is more from above than in FIG. 2.

FIG. 3 is like FIG. 2 except that the spout 302 is absent in FIG. 3.

Figure 4:
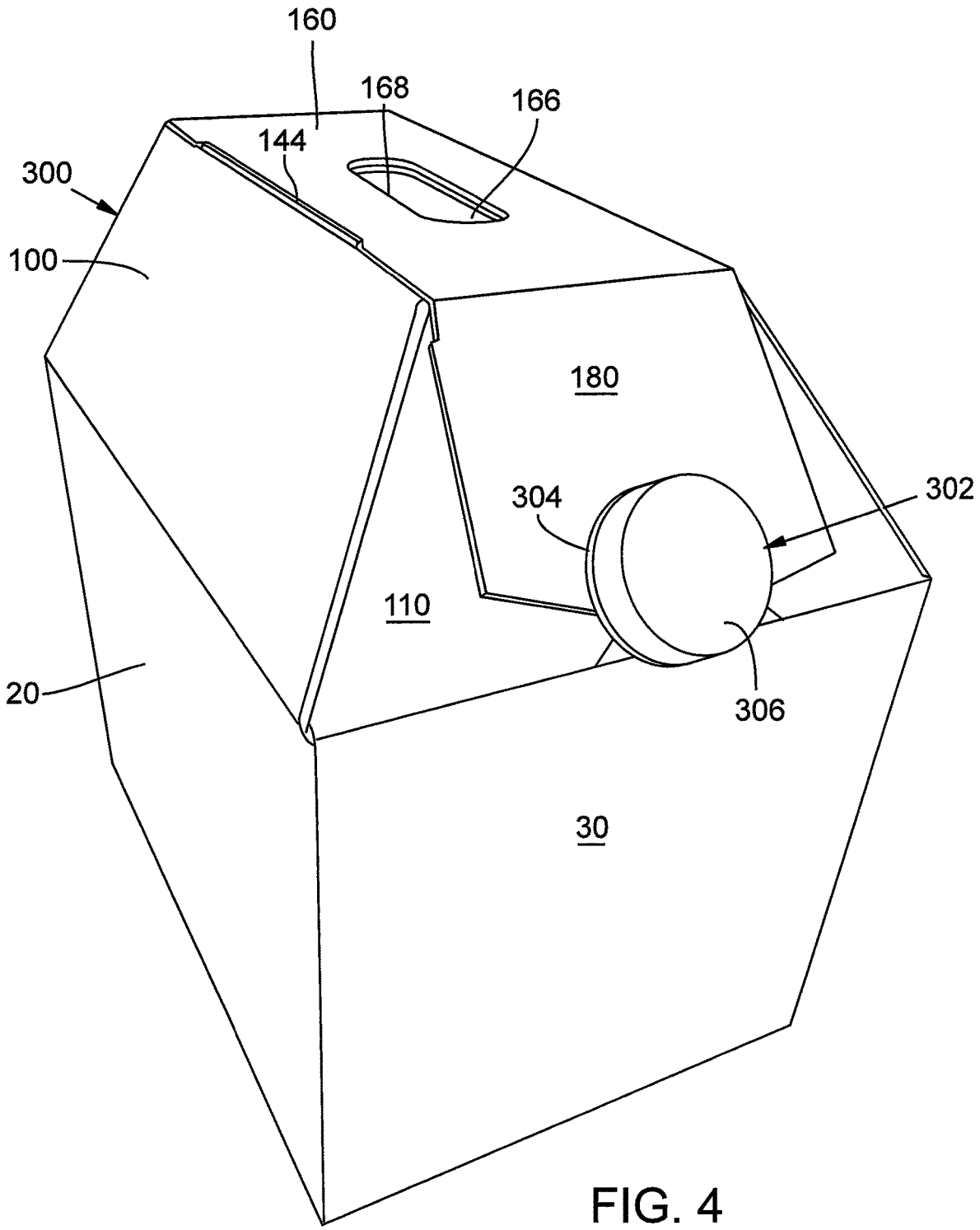
FIG. 4 is a perspective view of the container of FIG. 2 looking toward the front left side of the container.

FIG. 4 is a left perspective view of the container erected from the blank 10 of FIG. 1.

Figure 5:
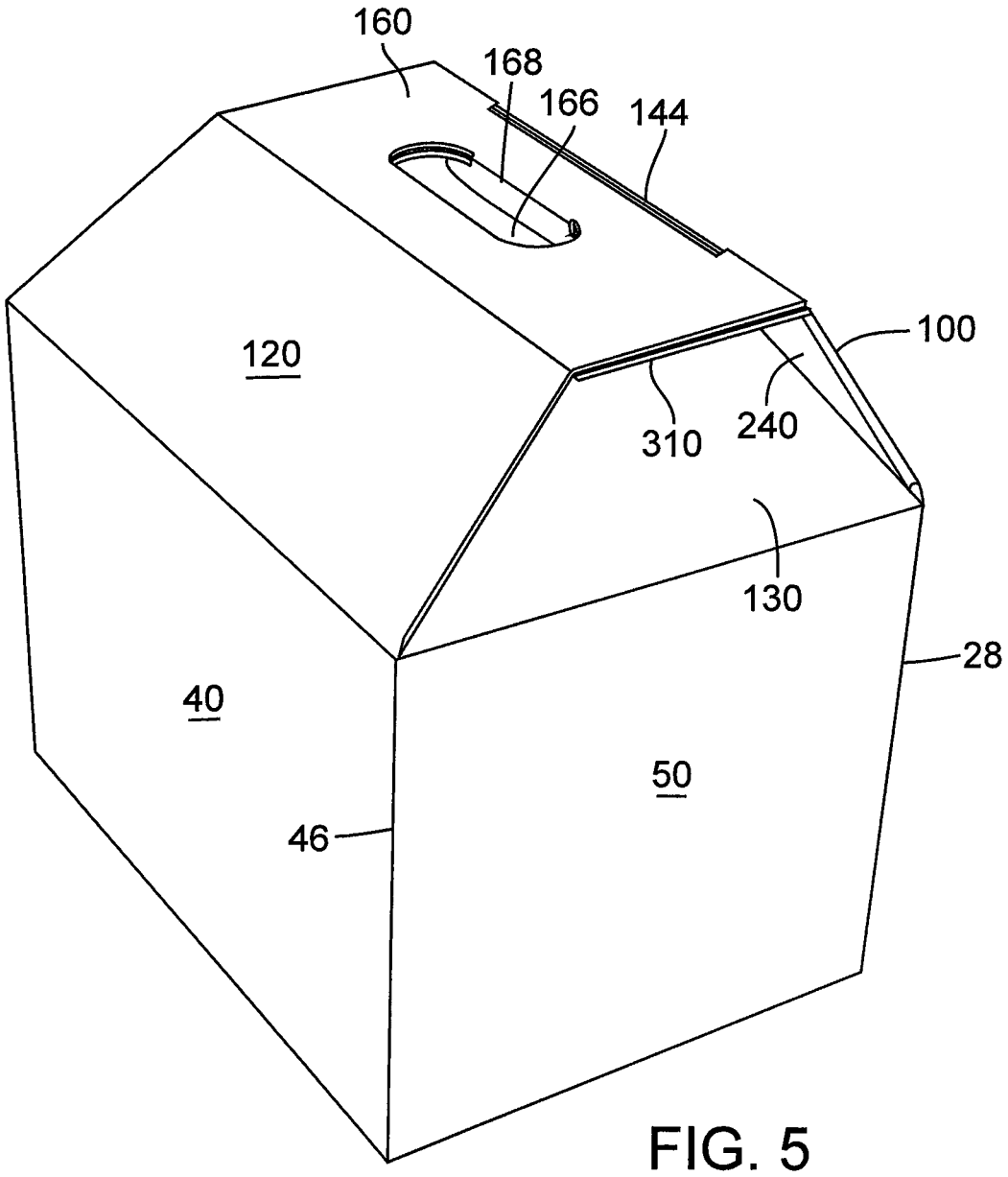
FIG. 5 is a rear perspective view of the container of FIG. 2.

FIG. 5 is a rear perspective view of the container of FIG. 2. In FIG. 5, one can see the eave 310 formed by the overhanging portions of outer top panel section 160 and inner top panel section 140 that overhang the exterior surface of the inwardly and upwardly sloped rear shoulder wall panel section 130.

Figure 6:
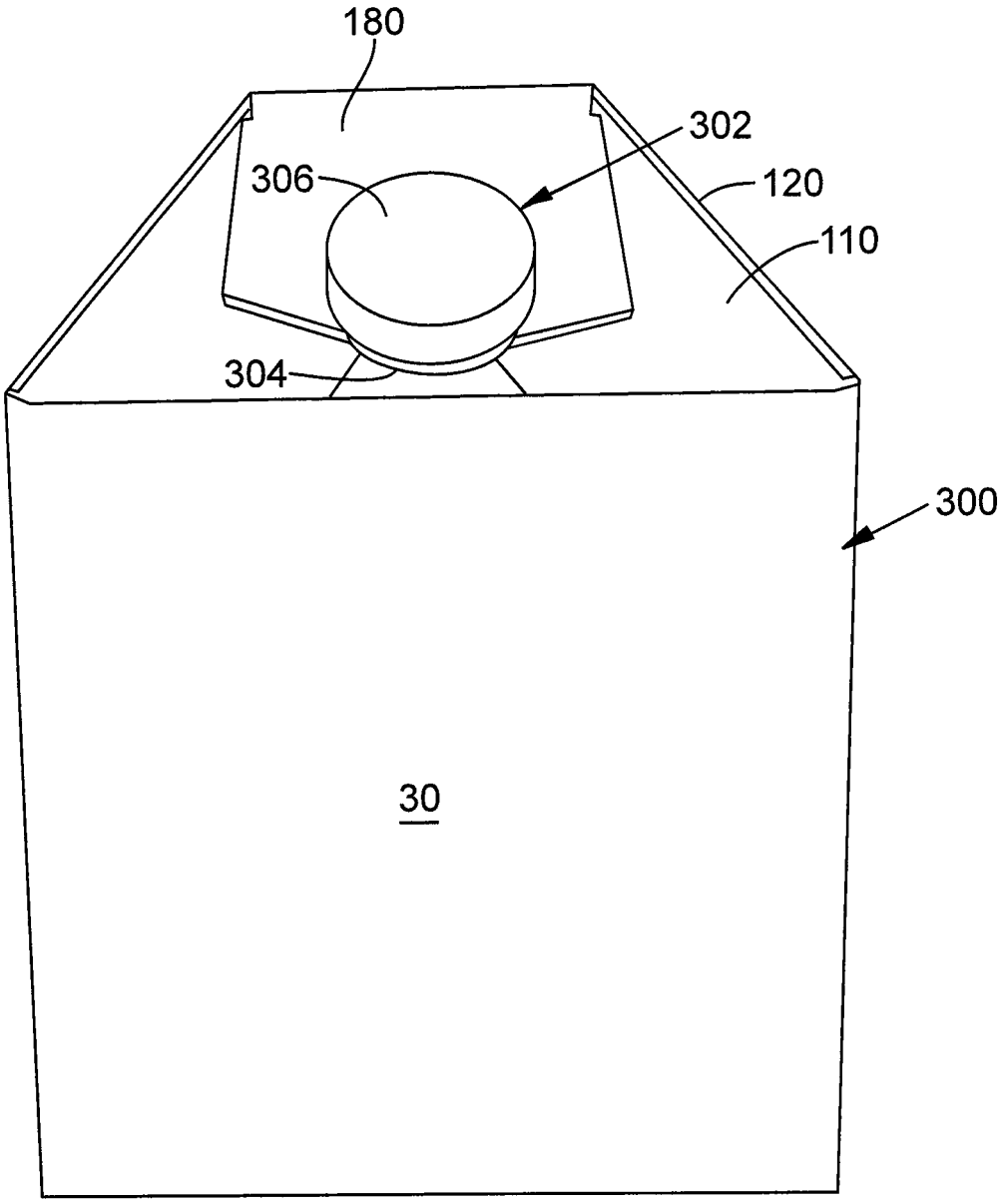
FIG. 6 is a front elevational view of the erected container of FIG. 2.

FIG. 6 is a front elevational view of the erected container.

Figure 7:
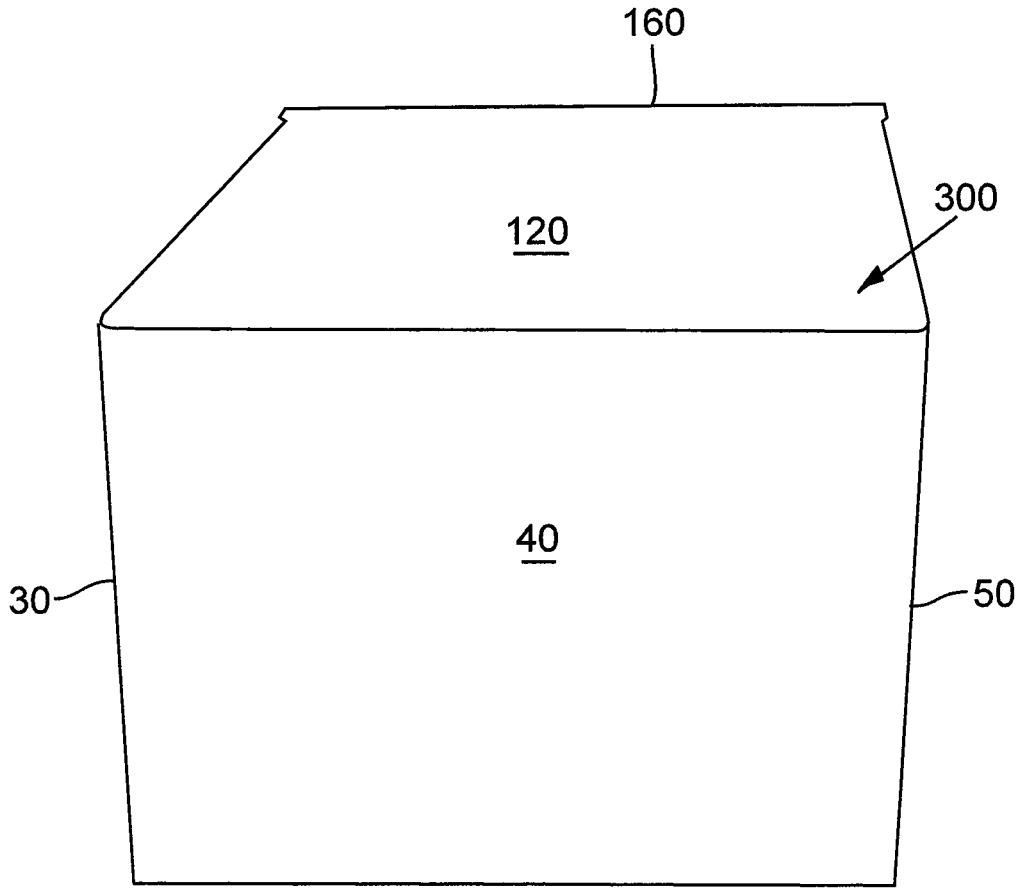
FIG. 7 is a right-side elevational view of the erected container; the left side elevational view being the mirror image of FIG. 7.

FIG. 7 is a right side elevational view of the erected container; the left side elevational view being the mirror image of as in FIG. 7. In FIG. 7 the spout has been omitted for convenience.

Figure 8:
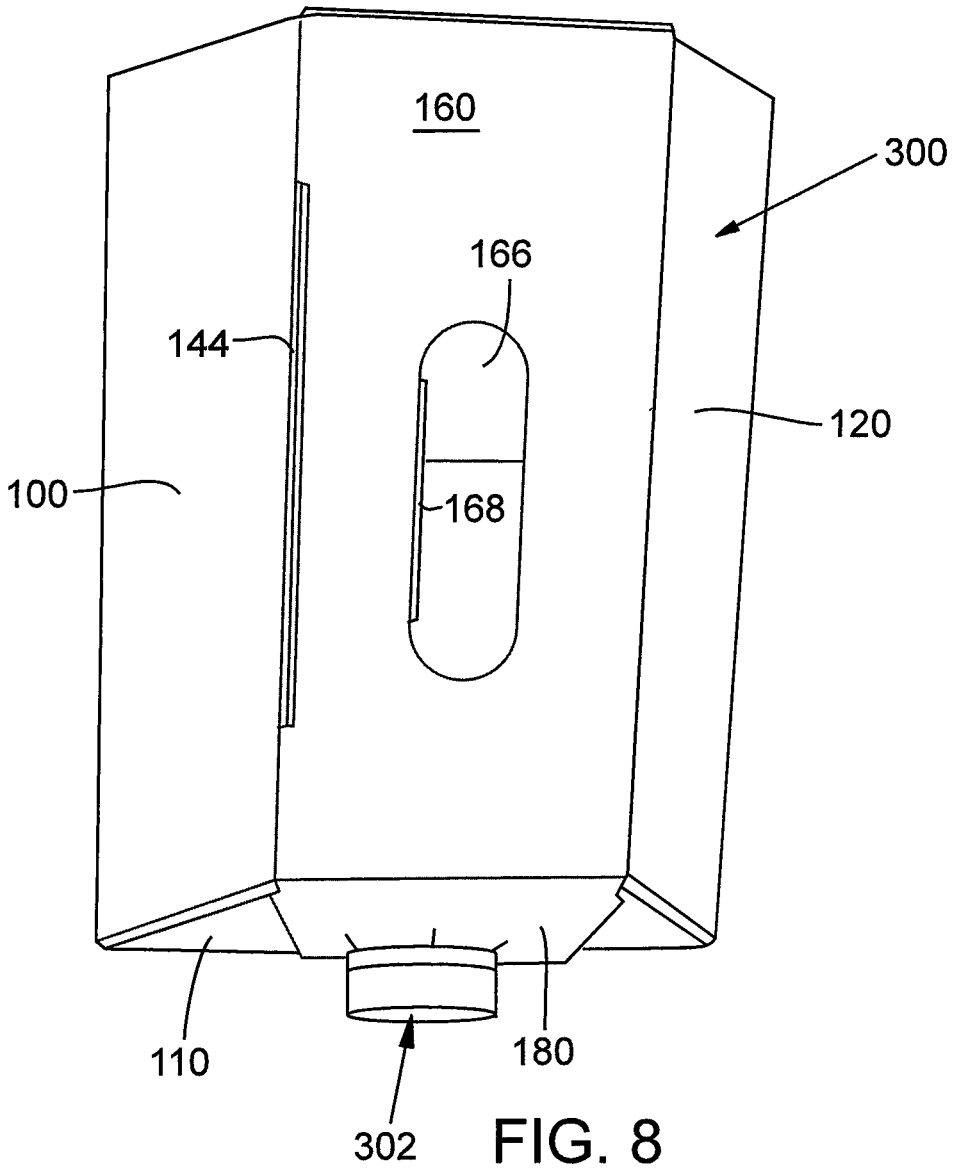
FIG. 8 is a top view of the container of FIG. 2.

FIG. 8 is a top view of the erected container of FIG. 2.

Figure 9:
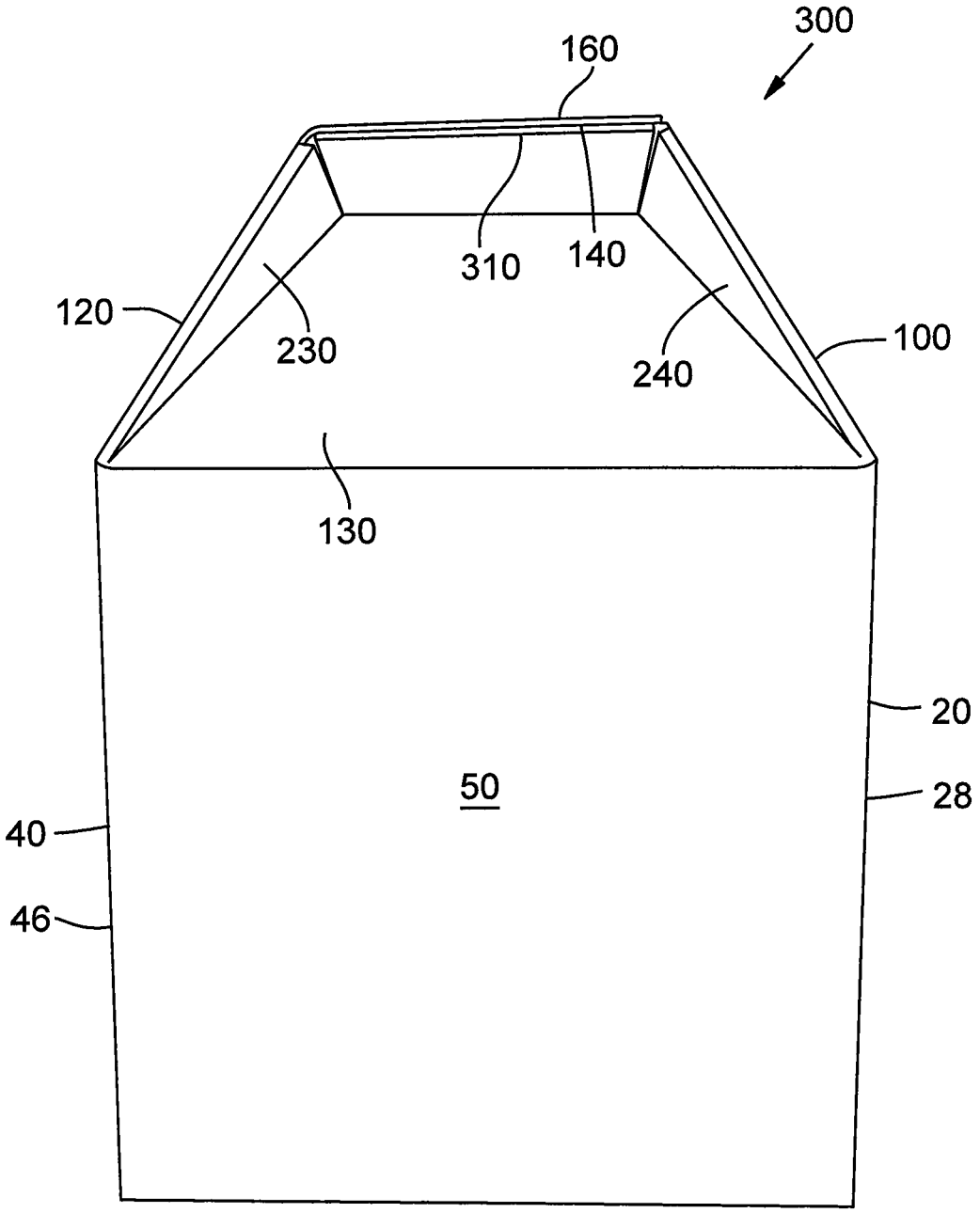
FIG. 9 is a rear elevational view of the container of FIG. 2.

FIG. 9 is a rear elevational view of the container of FIG. 2. In FIG. 9, the overhang created by the top panels 140, 160 and the inward slope of rear shoulder wall section 130 is readily seen.

Figure 10:
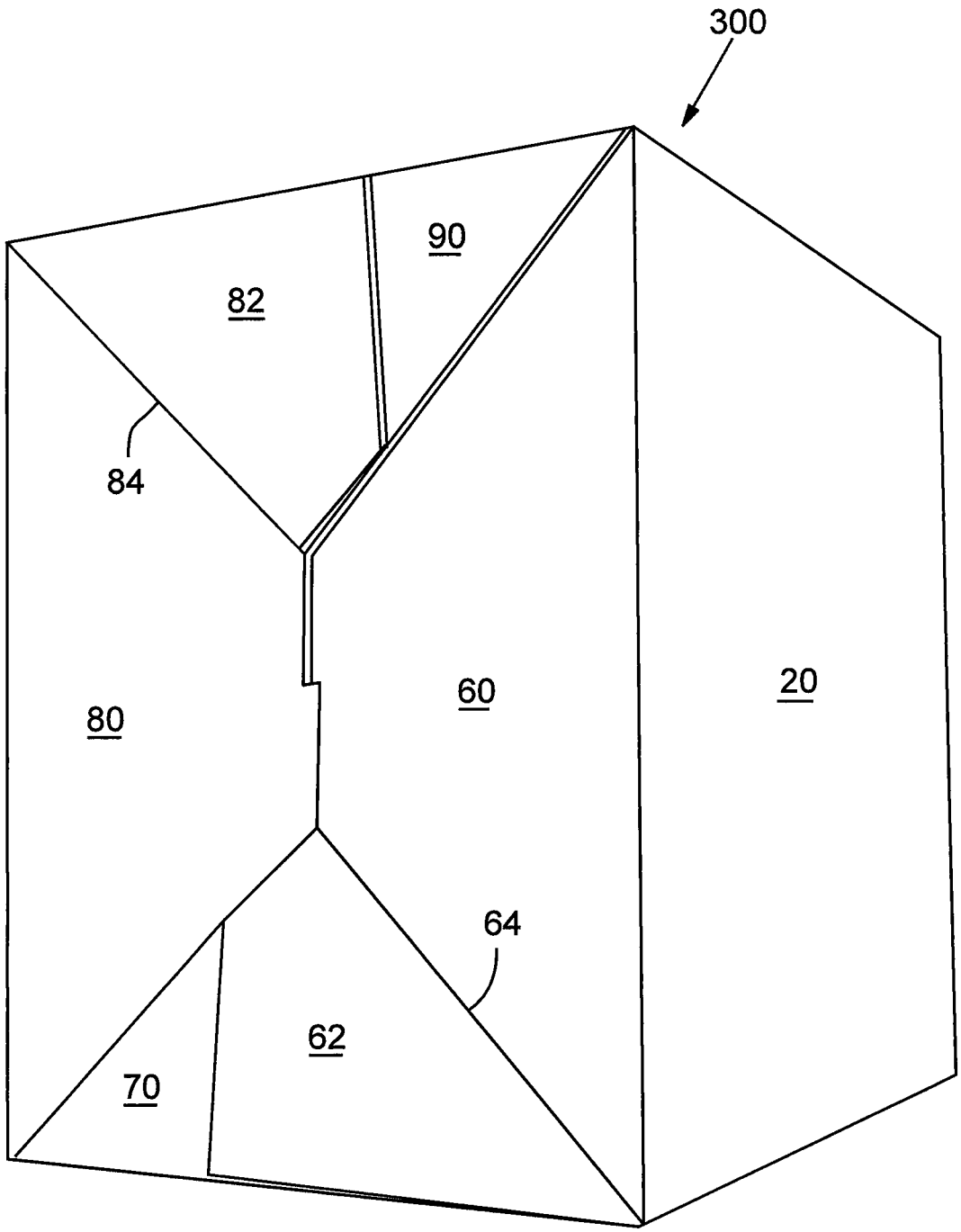
FIG. 10 is a bottom view of the container of FIG. 2; the various features shown in this FIG. 10 are optional and can be dashed in a design as not being part of the ornamental features of the design.

FIG. 10 is a bottom view of the erected container 300. In FIG. 10, section 62 of the bottom flap 60 is secured to the exterior surface of the bottom flap 70 and section 82 of the bottom flap 80 has been secured to the exterior surface of bottom flap 90. With this construction, the bottom flaps fold inwardly and can be readily unfolded to form the bottom with interlocking central portions of the panel sections 60 and 80 completing the bottom when erected.

Figure 11:
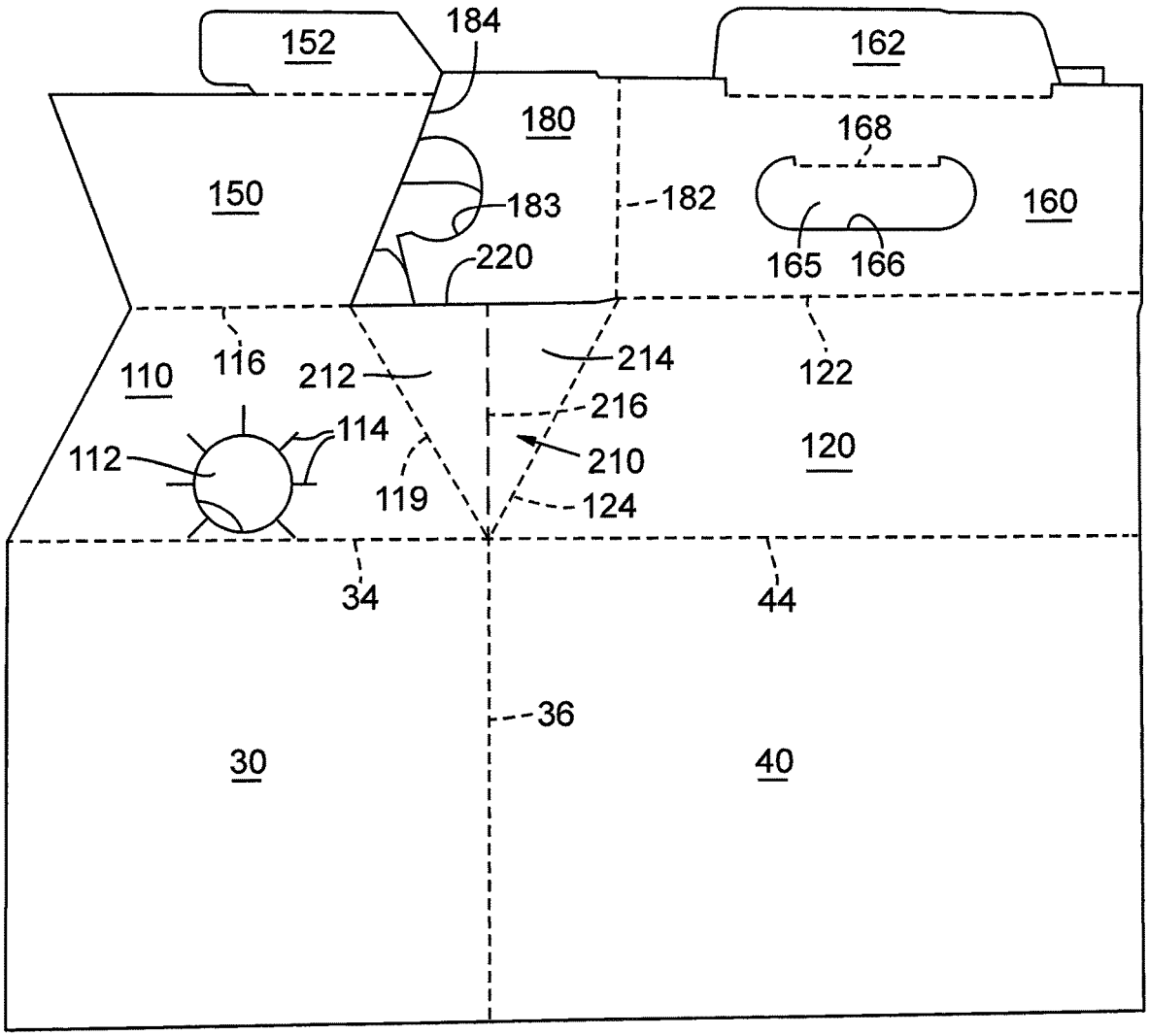
FIGS. 11 and 12 illustrate front and rear views of the container that can be manufactured from the blank of FIG. 1 in a broken-down flattened form ready for shipment. In this form, the bottom panels have been interconnected and folded inwardly.
Figure 12:
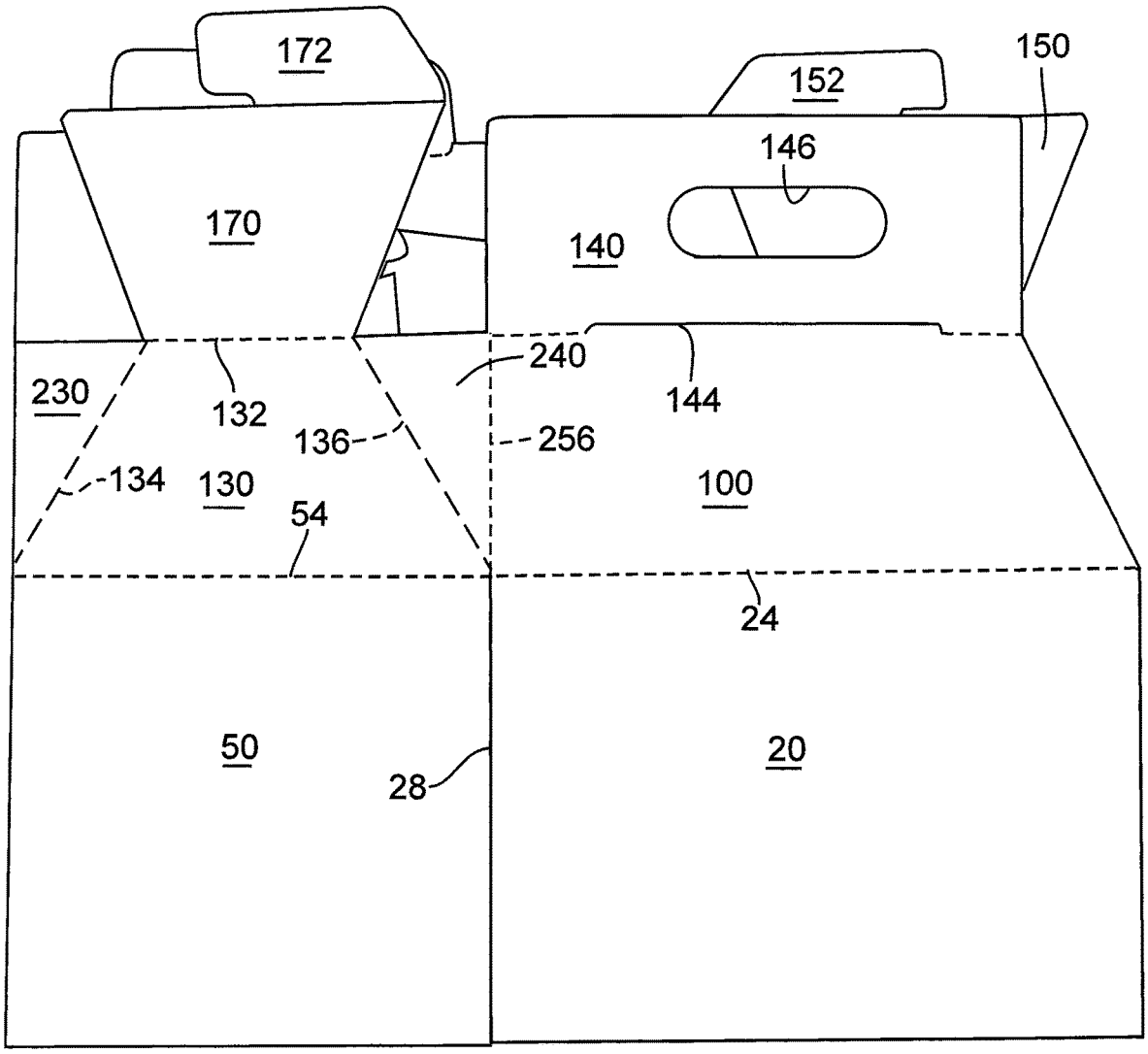

FIGS. 11 and 12 illustrate front and rear views of the manufactured container in a broken down flattened form ready for shipment. In this form, the bottom panels have been interconnected and folded inwardly. In addition, the glue flange 250 and dart panel forming section 252 have been secured respectively to the interior surface of rear wall panel 50 and dart or web 240. Also, as can be seen in FIG. 11, from this view the side wall panel overlies the rear wall panel 50 and a portion of the side wall panel 20 and the front wall panel 30 overlines the side wall panel 20.

Figure 13:
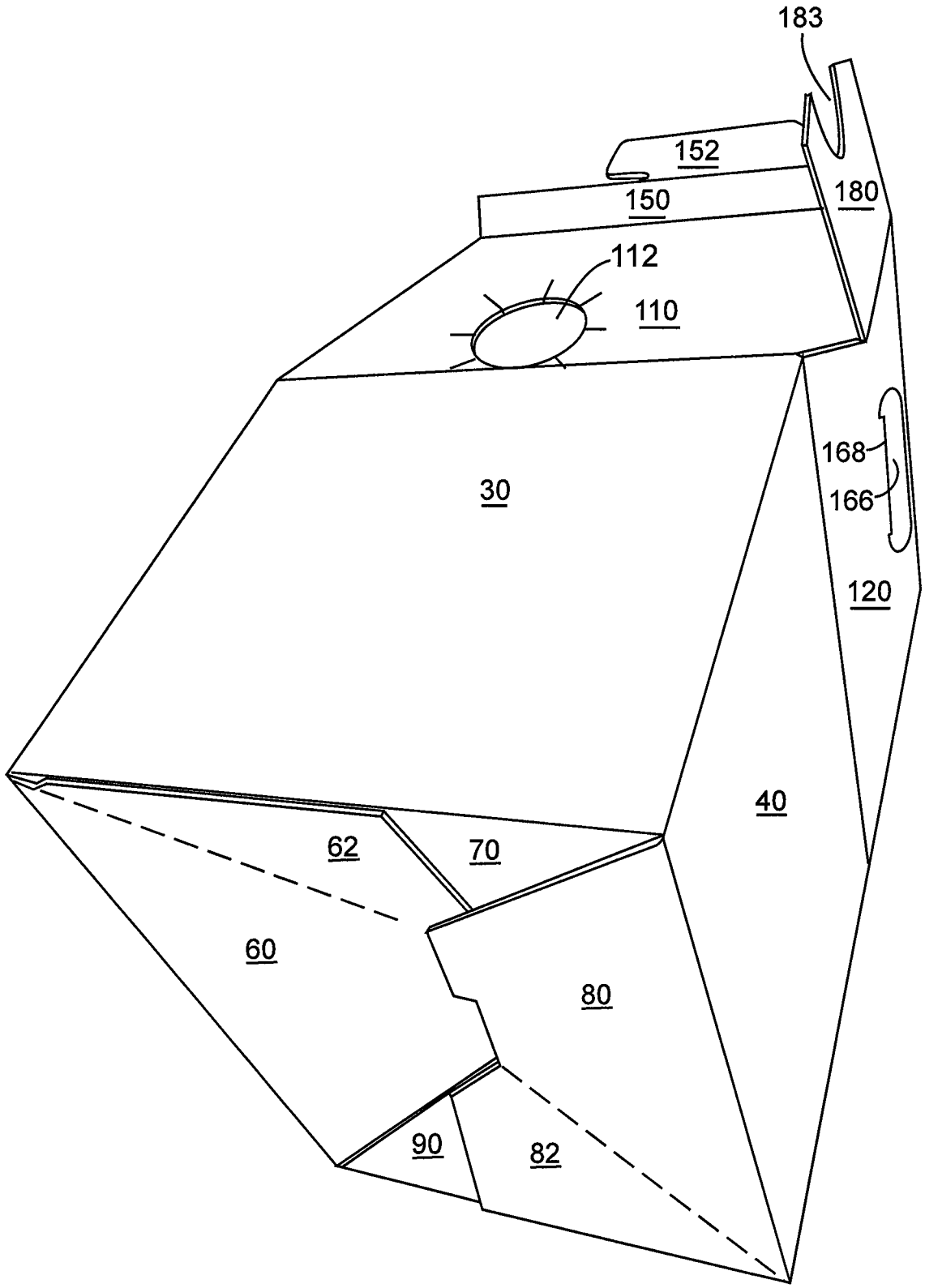
FIG. 13 illustrates a partially erected container of FIG. 2 following partial erection of the container to assemble the bottom of the exemplary container.

FIG. 13 illustrates the container following partial erection of the container to assemble the bottom of the container.

Figure 14:
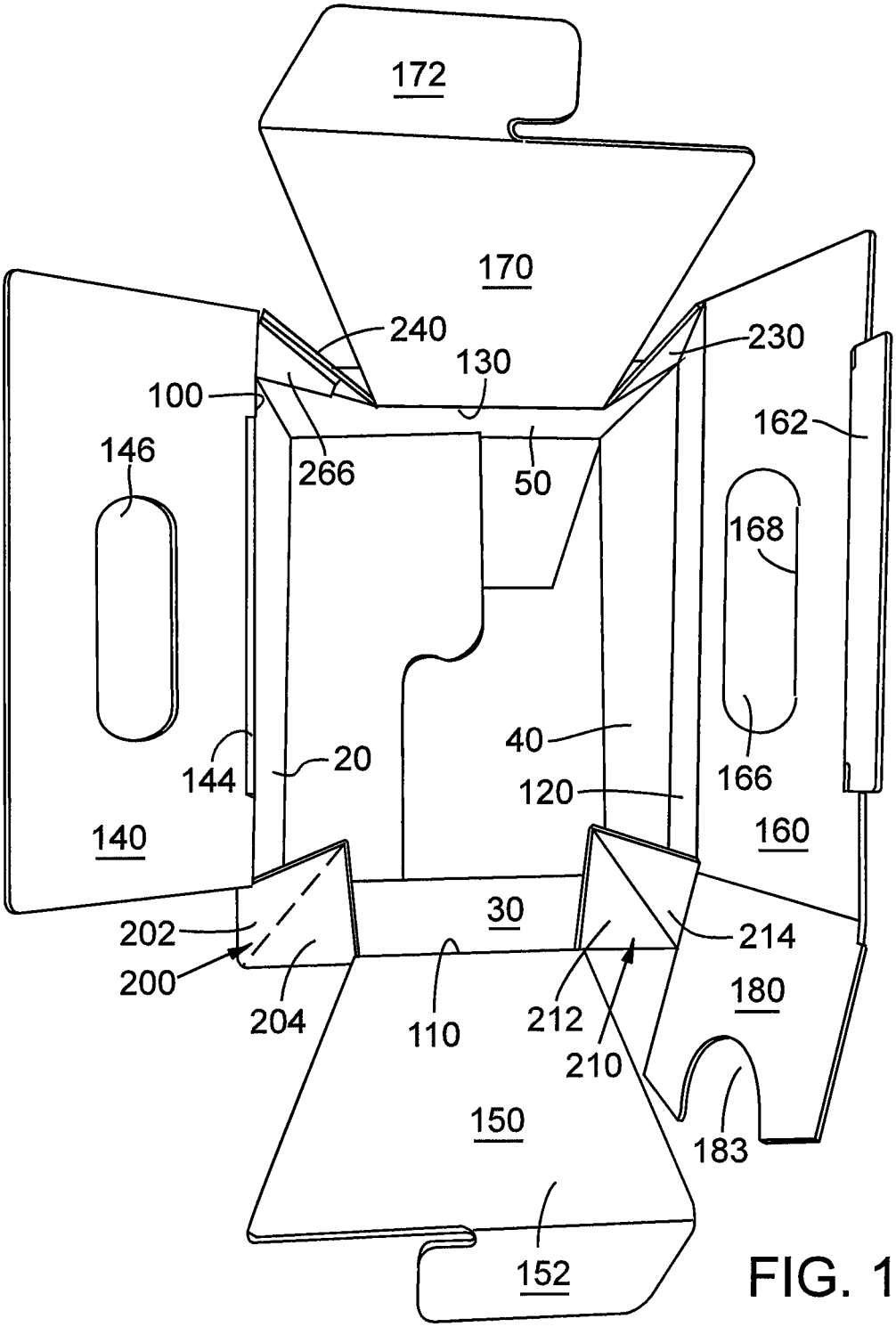
FIG. 14 is a top view of the open partially erected container with the bottom assembled and with the corner forming webs shown partially folded inwardly at the respective corners of the container.

FIG. 14 is a top view of the open partially erected container with the bottom assembled and with the webs 200, 210 and 230, 240 shown partially folded inwardly at the respective corners of the container.

Figure 15:
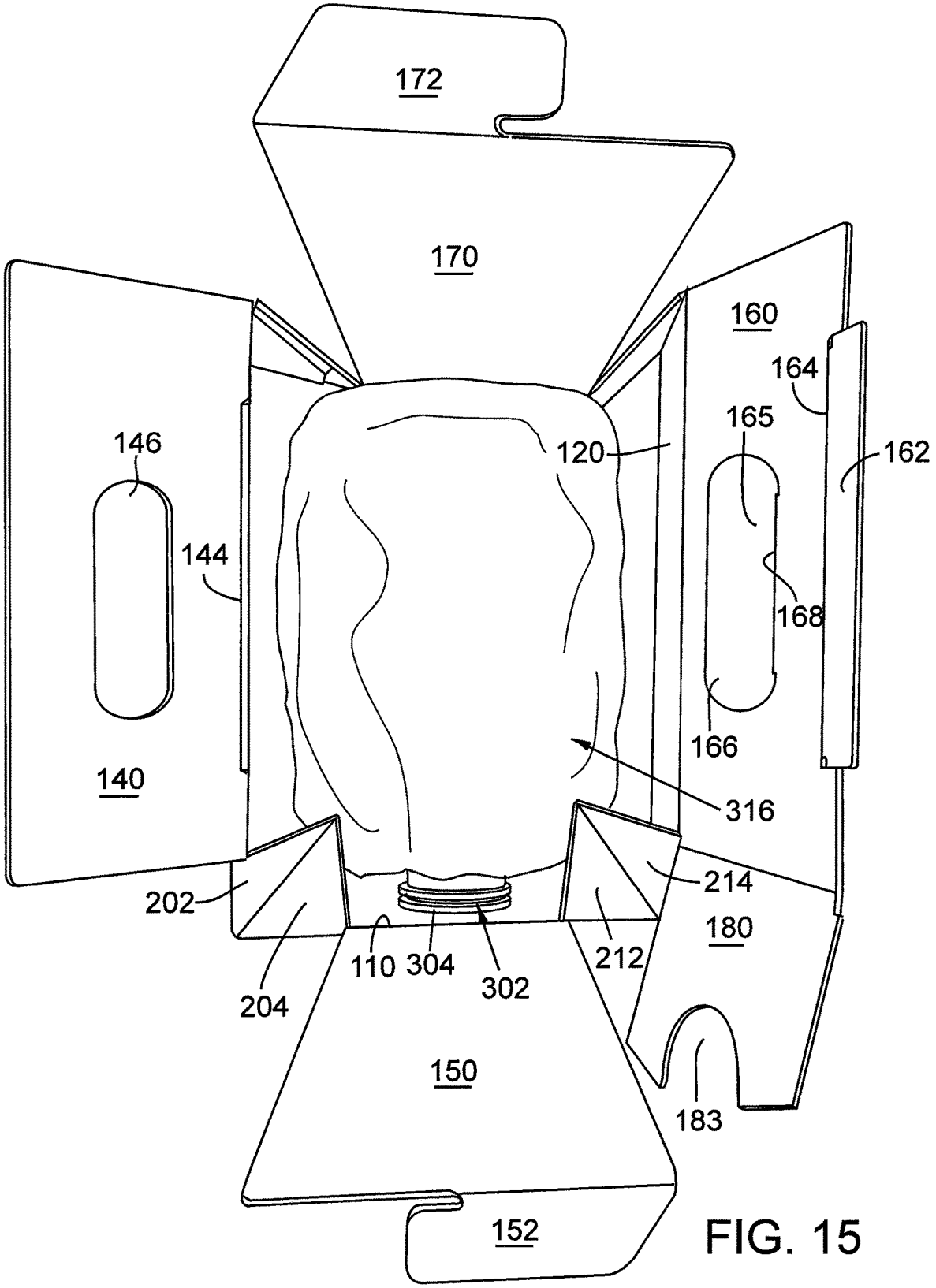
FIG. 15 is like FIG. 14 but with an internal liquid container in the form of a flexible fillable bag shown positioned in the container.

FIG. 15 is like FIG. 14 but with an internal liquid container in the form of a flexible fillable bag 316 shown positioned in the container. These bags are commercially available and are commonly used in coffee totes, such as provided when ordering coffee at STARBUCKS® or other coffee vendors. Typically, the bags have a plurality of heat sealable layers with an inside taste-neutral layer, a middle insulating layer, and an outer layer. The spout is adhesively or otherwise secured to a bag opening. The neck of the spout typically includes one or more annular grooves and a rim. When the bag is coupled to the container, the neck is inserted through the opening in the front shoulder panel section and the flat 180 is positioned behind the rim of the spout.

Figure 16:
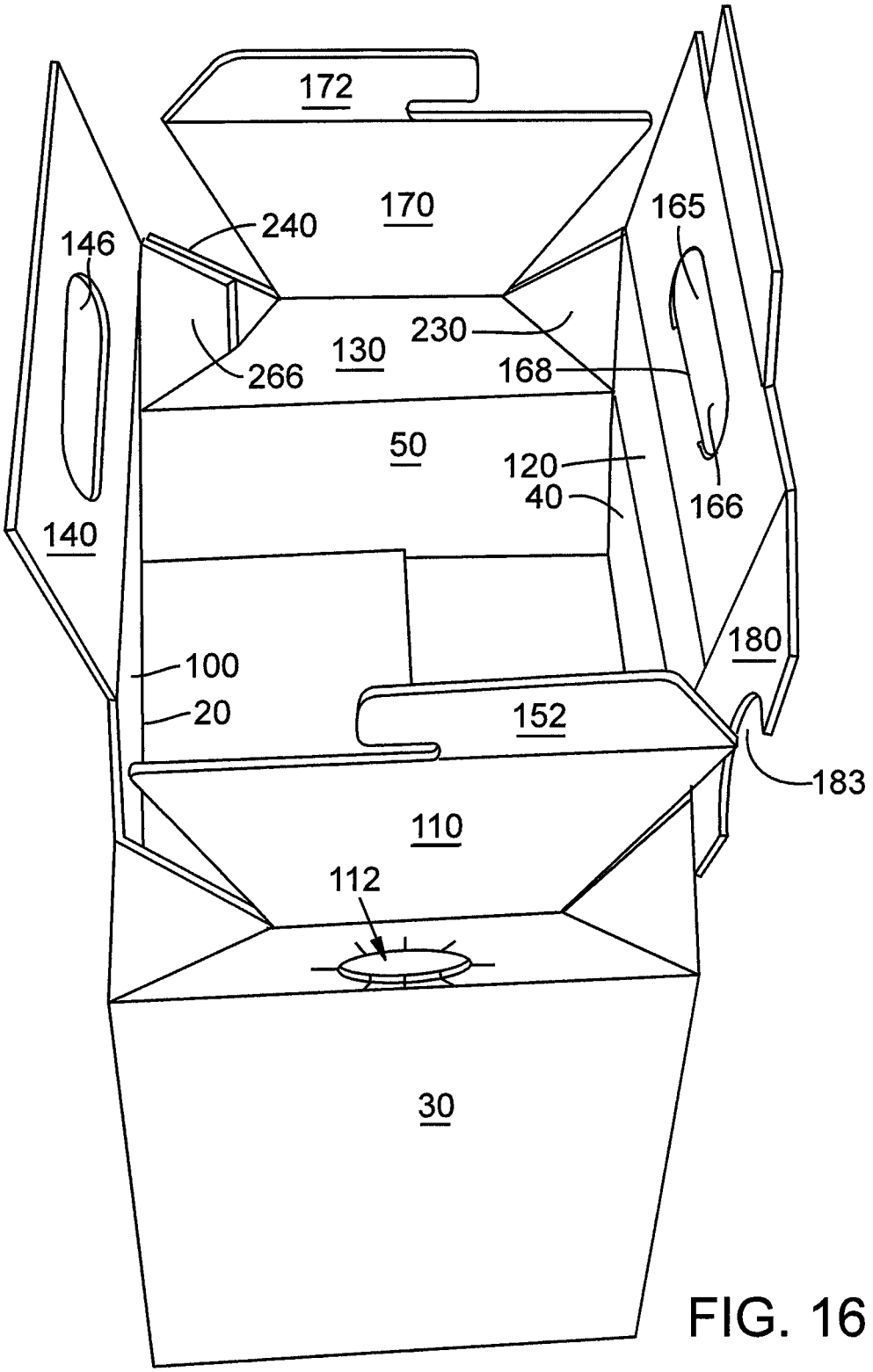
FIGS. 16-22 illustrate an exemplary approach for assembling the container from its flattened state shown in FIGS. 11 and 12.

FIGS. 16-22 illustrate an exemplary approach for assembling the container from its flattened state. In FIG. 16, the container is shown partially erected with the bottom unfolded as previously explained.

Figure 17:
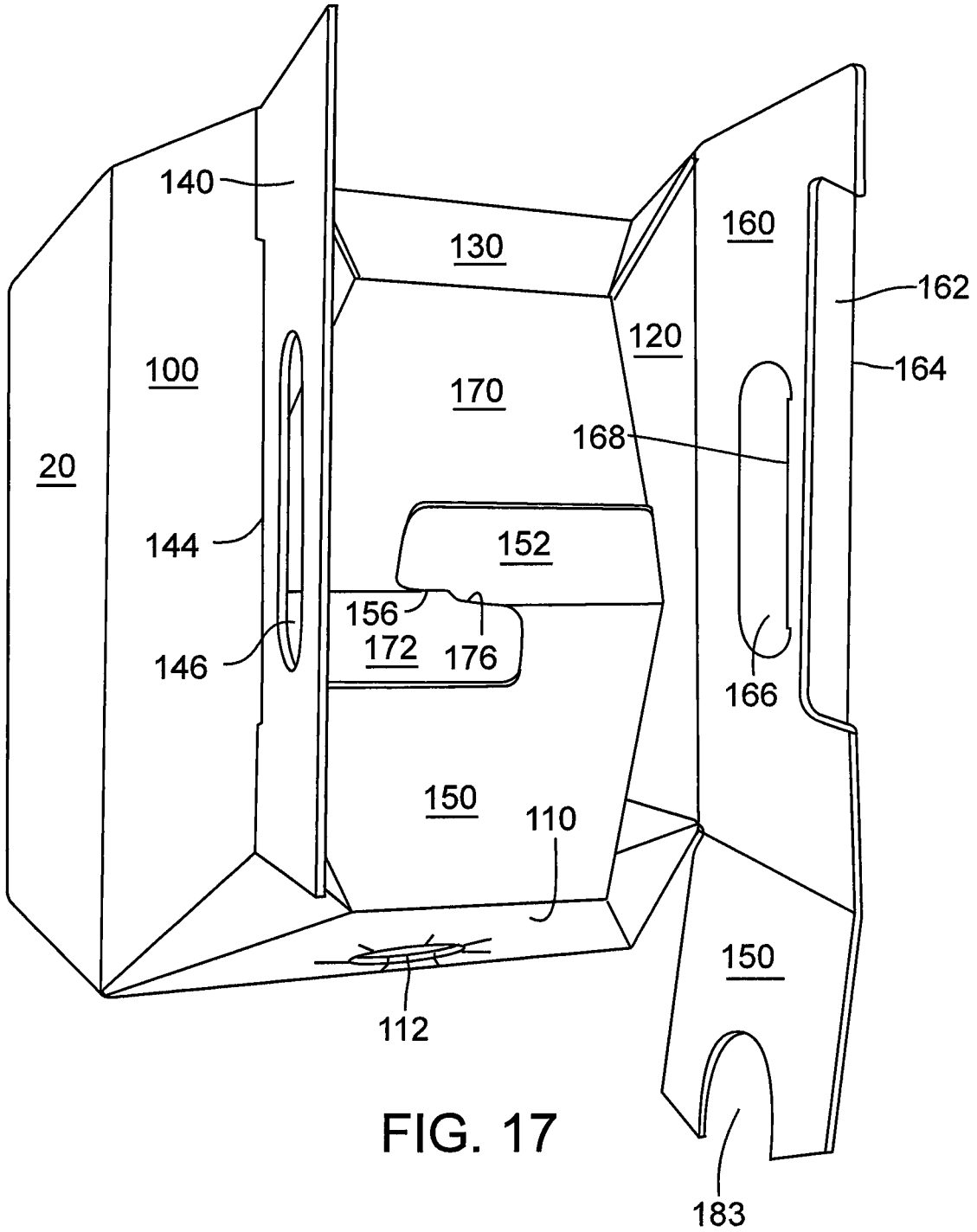
Figure 18:
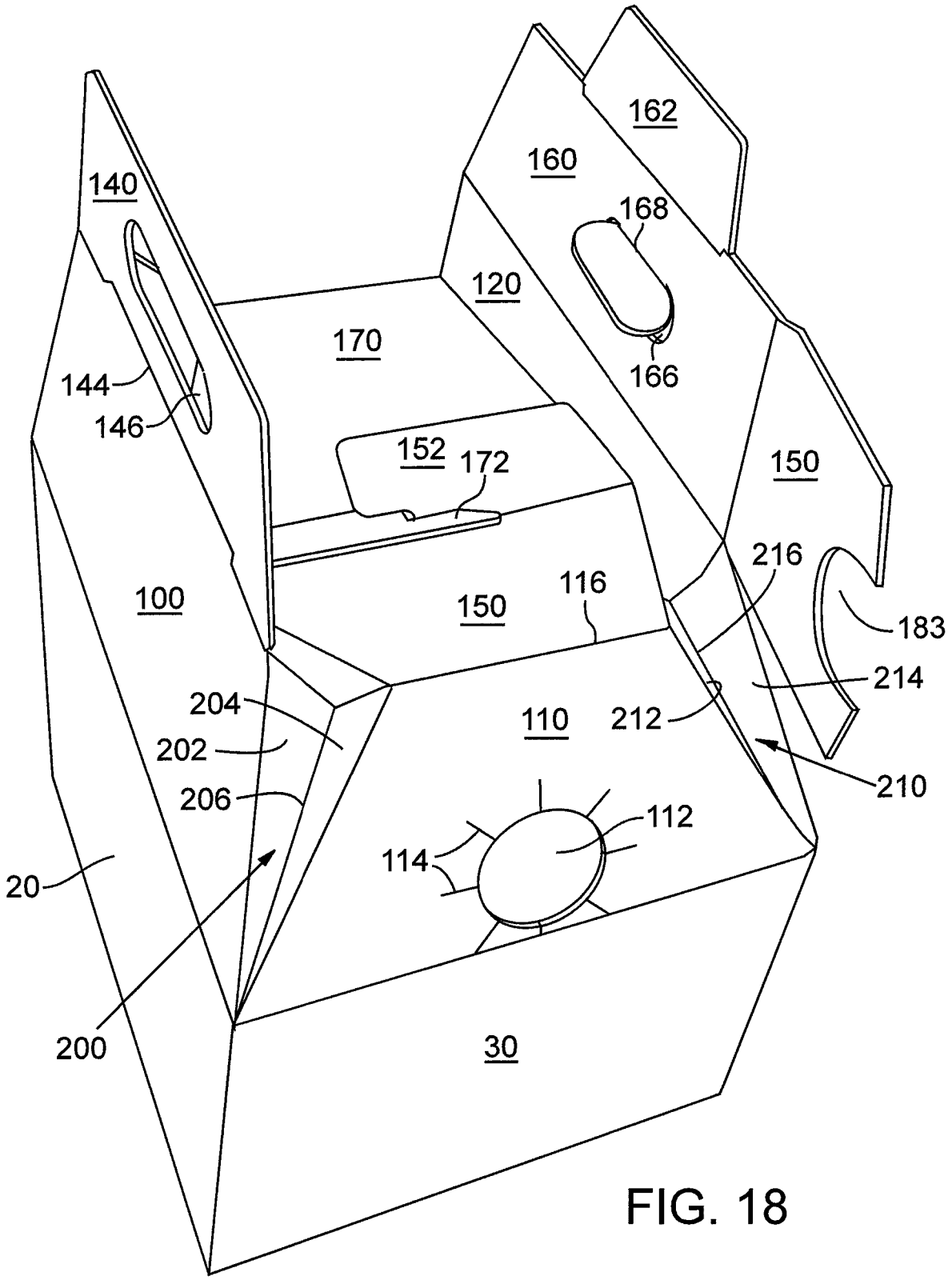

FIG. 17 illustrates inner shield panel sections 150, 170 folded inwardly with the tabs 152 and 172 interlocked by placing a portion of tab 172 in slot 156 of the tab 152 and a portion of tab 152 in the slot 176 of tab 172. The shield panel sections 150, 170 are sized to pull the front shoulder panel section 110 and the rear shoulder panel section 130 inwardly away from their respective front and rear walls panel sections 30, 50 to thereby inwardly and upwardly slope these shoulder panel sections. In addition, interlocking the shield panel sections 150, 170 pulls and holds the web portions 200, 210, 230, and 240 inwardly at the respective corners of the shoulders panel sections; which is illustrated in FIG. 18 for web portions 200 and 210.

Figure 19:
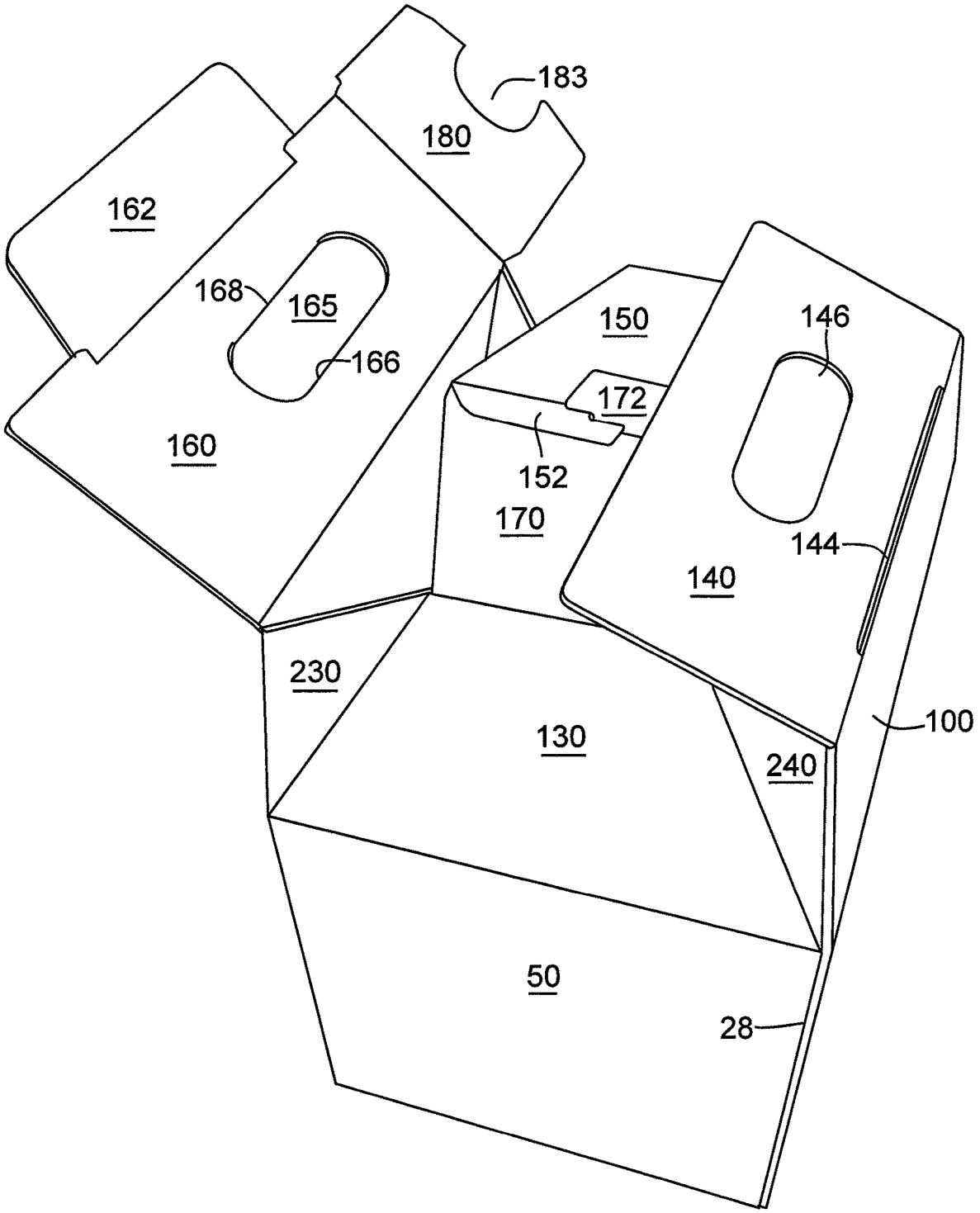

In FIG. 19, the inner top panel section 140 is shown being folded inwardly over the interconnected shield flaps 150, 170.

Figure 20:
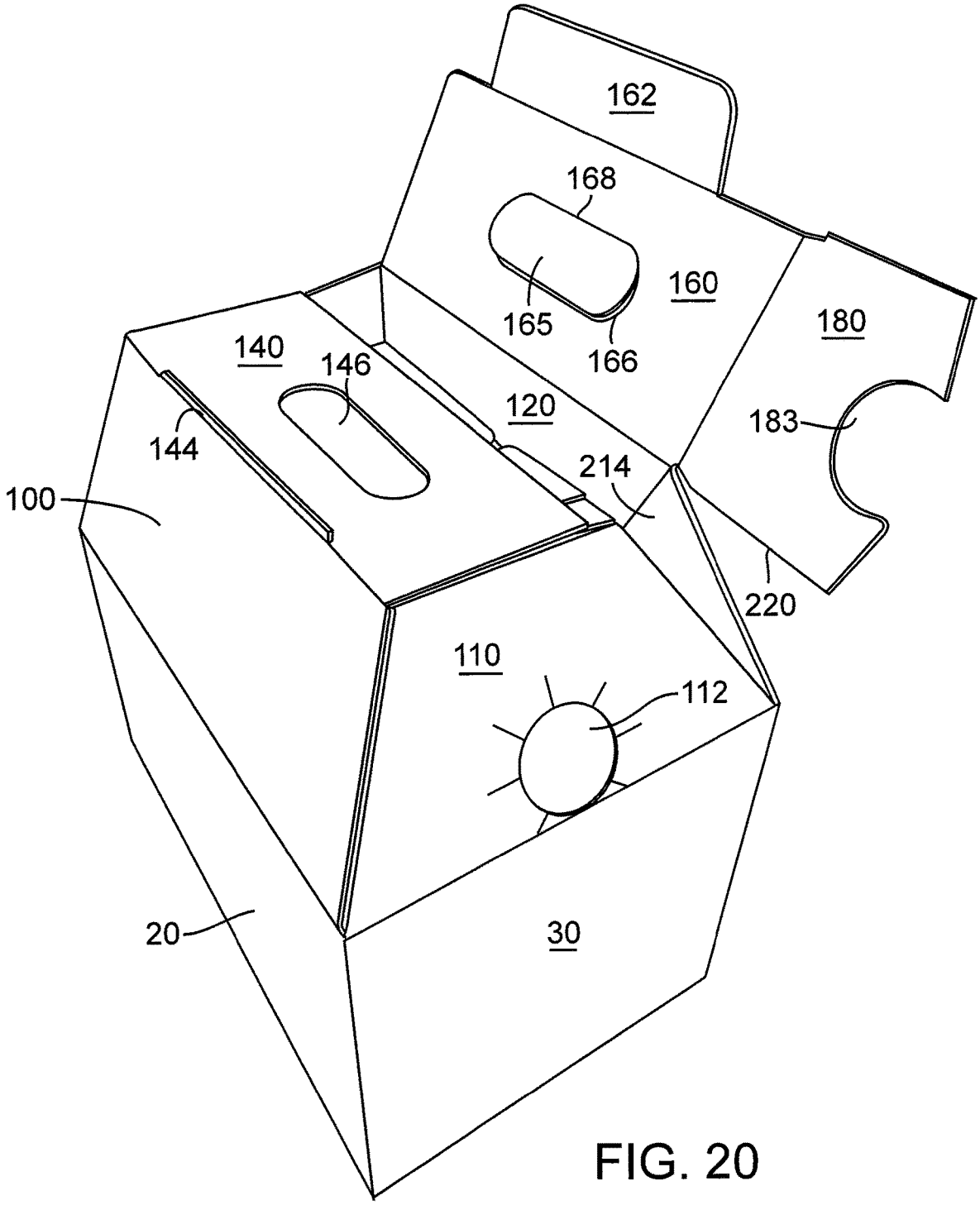

FIG. 20 shows the inner top panel 140 folded in position.

Figure 21:
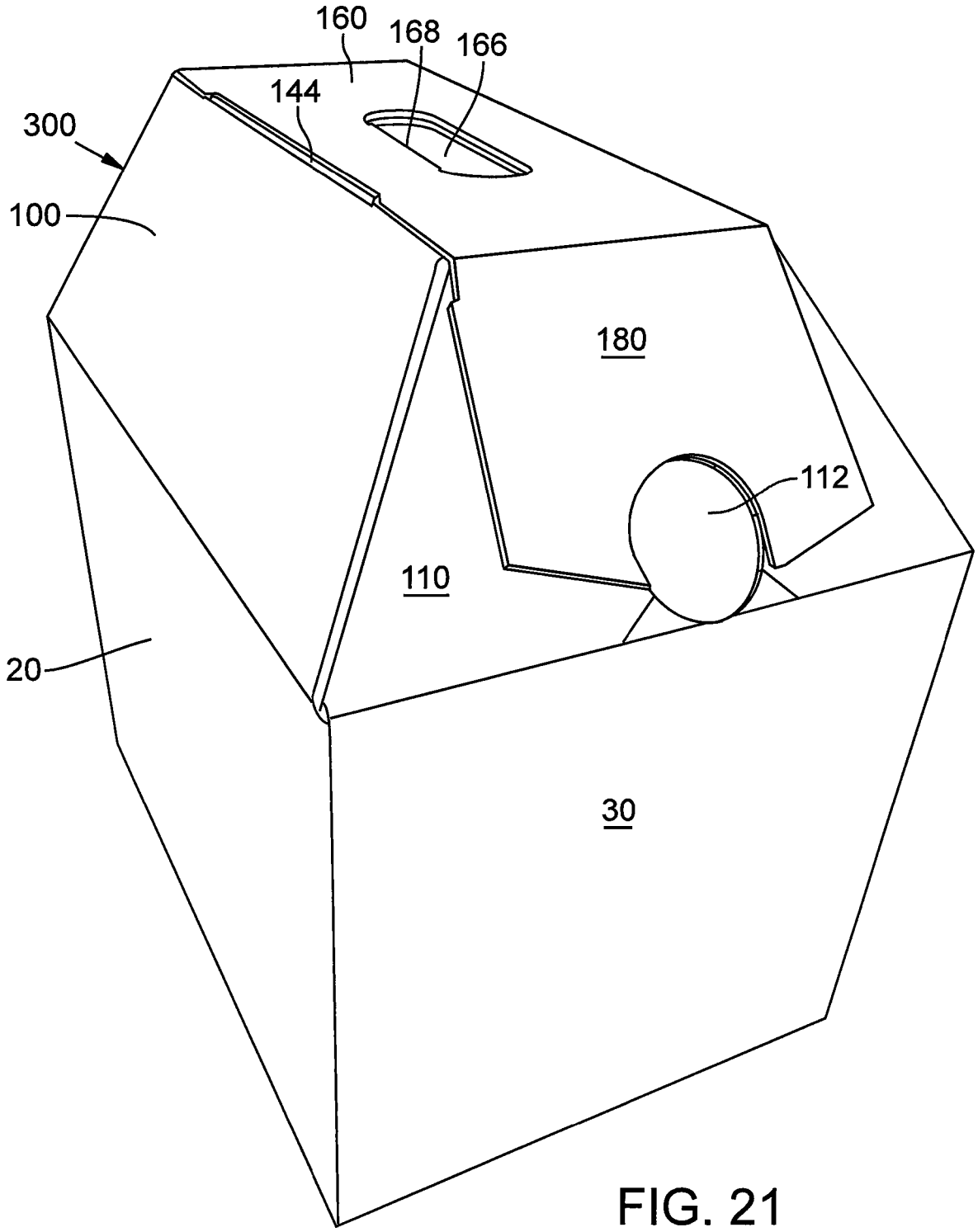

FIG. 21 illustrates the top panel 160 folded in its erected position with the tab 162 inserted into the slot 144. In addition, FIG. 21 illustrates the flap 180 folded down to a position where it would engage the spout if the spout were included in FIG. 21. FIG. 8 shows the flap 180 in the position shown in FIG. 21, but in engagement with the neck of a spout.

Having illustrated and described the principles of our invention with reference to a number of embodiments, it should be apparent to those of ordinary skill in the art that these embodiments may be modified in their arrangement and detail without departing from the inventive principles disclosed herein. Also, the invention is not limited to the container as a whole as the invention includes individual inventive features as well as combinations of such features. For example, the combination of a hand hold with interlocking thermal insulating shields between the hand hold and an internal beverage container is one such feature.

That which is claimed is:

1. A beverage container for housing an internal liquid container with a spout, the beverage container comprising:

a bottom;

at least four walls extending upwardly from the container bottom, the side walls each having an upper edge portion;

the side walls comprising a first set of opposed walls comprising first and second wall panel sections and a second set of opposed walls comprising third and fourth wall panel sections;

one of the wall panel sections comprising a spout receiving opening therethrough;

a first shield panel section comprising a first proximal end portion coupled to the first wall panel section and a first distal end portion spaced inwardly from the first wall panel section and overlaying at least a portion of the internal liquid container, a second shield panel section comprising a second proximal end portion coupled to the second wall panel section and a second distal end portion spaced inwardly from the second wall panel section and overlaying at least a portion of the internal liquid container, the first distal end portion being coupled to the second distal end portion;

a first top panel section coupled to the third wall panel section and extending inwardly above the first and second shield panel sections and over the internal liquid container;

a second top panel section coupled to the fourth wall panel section and extending inwardly and positioned to overlay the first top panel section;

wherein a gap is provided between the first and second distal end portions and the first top panel section; and wherein the first and second top panel sections comprise a handle.

2. A beverage container according to claim one wherein the handle comprises a first handle opening through the first top panel section and a second handle opening through the second top panel section, the handle openings being sized for insertion of a plurality of the user's fingers of one hand through the handle openings and positioned above the gap between the first and second distal end portions.

3. A beverage container according to claim 1 wherein the first wall panel section comprises a front wall panel of the beverage container with the spout receiving opening therethrough, the second wall panel section comprises a rear wall panel of the beverage container, the third wall panel section comprising a first side wall panel of the beverage container, and the fourth wall panel section comprising a second side wall panel section of the beverage container.

4. A beverage container according to claim 1 wherein the first wall panel section comprises a front wall panel section comprising an inwardly and upwardly extending front shoulder panel portion, the front shoulder panel portion having a spout receiving opening therethrough, the first shield panel section extending inwardly from an upper edge of the of the first shoulder panel portion, wherein the third wall panel section comprises a first side wall panel section comprising an inwardly and upwardly extending first side wall shoulder panel portion, the first top panel section extending inwardly from an upper edge of the first side wall shoulder panel portion, and the fourth wall panel section comprises a second side wall panel section comprising an inwardly and upwardly extending second side wall shoulder panel portion, the second top panel section extending inwardly from an upper edge of the second side wall shoulder panel portion.

5. A beverage container according to claim 4 wherein the second wall panel section comprises a rear wall panel section comprising an inwardly and upwardly extending rear shoulder panel portion, the second shield panel section extending inwardly from an upper edge of the of the rear wall panel section.

6. A beverage container according to claim 5 wherein the first and second top panel sections overhang the rear shoulder panel portion and comprise an outwardly projecting eave portion spaced from at least a portion of rear shoulder panel portion.

7. A beverage container according to claim 5 wherein the handle comprises a first handle opening through the first top panel section and a second handle opening through the second top panel section, the handle openings being sized for insertion of a plurality of the user's fingers of one hand through the handle openings and positioned above the gap between the first and second distal end portions.

8. A beverage container according to claim 7 wherein the second top panel section comprises a spout engaging flap with a recess sized and positioned to engage a spout inserted through the spout receiving opening.

9. A beverage container according to claim 8 wherein the bottom comprises a respective bottom flap coupled to a lower edge of each of the wall panel sections, the bottom flap coupled to the first wall panel section being adhesively secured to the third wall panel section and the bottom flap coupled to the second wall panel section being adhesively secured to the fourth wall panel section, the bottom flaps being configured to fold inwardly between the wall panels when the container is in a knocked down state and to fold to form the bottom of the container as the wall sections are spread apart from one another as the container is erected from the knock down state to a partially erected state.

10. A beverage container according to claim 4 wherein a first foldable web is positioned between and coupled to the front shoulder panel portion and to the first side wall shoulder panel portion, wherein a second foldable web is provided between and coupled to the front shoulder panel portion and the second shoulder panel portion, wherein the span of the first and second shield panel sections in a first direction between the first and second wall panel sections when coupled together is less than the span of the bottom of the container in the first and section direction between the first and second wall panel sections, such that with the first and second distal end portions of the first and second shield panel sections coupled together, the first and second webs are folded inwardly and the front shoulder panel portion is inclined inwardly.

11. A beverage container according to claim 10 wherein the first web comprises first and second triangular darts separated by a first fold line that is aligned with the intersection of the front panel section and the first wall panel section; and wherein the second web comprises third and fourth triangular darts separated by a second fold line that is aligned with the intersection of the front panel section and the second wall section.

12. A beverage container according to claim 10 wherein a third foldable web is positioned between and coupled to the rear shoulder panel portion and to the first side wall shoulder panel portion, wherein a fourth foldable web is provided between and coupled to the rear shoulder panel portion and the second shoulder panel portion, wherein the span of the first and second shield panel sections in a first direction between the first and second wall panel sections when coupled together is less than the span of the bottom of the container in the first and section direction between the first and second wall panel sections, such that with the first and second distal end portions of the first and second shield panel sections coupled together, the first, second, third and fourth webs are folded inwardly and the front shoulder panel portion and the rear shoulder panel portion are both inclined upwardly and inwardly.

13. A beverage container according to claim 12 wherein the first web comprises first and second triangular darts separated by a first fold line that is aligned with the intersection of the front panel section and the first wall panel section; and wherein the second web comprises third and fourth triangular darts separated by a second fold line that is aligned with the intersection of the front panel section and the second wall section; and wherein the third web comprises a fifth triangular dart having a side edge aligned with the intersection of the first wall panel section and the rear wall panel section and a sixth triangular dart having a side edge aligned with the intersection of the second wall panel section and the rear wall panel section.

14. A beverage container according to claim 13 wherein each of the darts is of a right triangular shape with an apex at a lower position than the rest of the dart when the container is resting on the container bottom.

15. A beverage container according to claim 1 wherein the first and second top panel sections overhang the second wall panel section and comprise a double-layered, outwardly projecting eave portion spaced from at least a portion of the second wall panel section and configured to be gripped by a user.

16. A beverage container according to claim 1 made from a single one-piece paperboard blank.

17. A beverage container according to claim 1 including a beverage bag within the container with a spout inserted through the spout receiving opening.

18. A beverage container according to claim 1 wherein the first and second distal end portions are detachably coupled together without any fasteners or adhesive.

19. A beverage container according to claim 18 wherein the second top panel section is detachably coupled to the first top panel section without any fasteners or adhesive.

20. A beverage container according to claim 1, wherein the first distal end portion of the first shield panel section is configured to interlock with the second distal end portion of the second shield panel section.

21. A beverage container according to claim 1, wherein the first shield panel section and the second shield panel section are sized to contact the third and fourth wall panel sections.

22. A beverage container for housing an internal liquid container with a spout, the beverage container comprising:

a plurality of wall panel sections including opposed front and rear wall panel sections and first and second opposed side wall panel sections, each of the wall panel sections comprising an upper wall edge and a lower wall panel edge when the wall panel sections are oriented in an upright orientation;

a plurality of bottom flap sections, each bottom flap section being coupled to the lower wall panel edge of a respective wall panel section, the bottom flap sections comprising a bottom of the container when the container is erected, and the wall panel sections are in an upright orientation;

a front shoulder panel section having upper and lower front shoulder panel edges, the lower front shoulder panel edge being coupled to the upper edge of the front wall panel section, a first side wall shoulder panel section having upper and lower first side wall shoulder panel edges, the lower first side wall shoulder panel edge being coupled to the upper wall edge of the first side wall panel section, and a second side wall shoulder panel section having upper and lower second side wall shoulder panel edges, the lower second side wall shoulder panel edge being coupled to the upper wall edge of the second side wall panel section;

at least the front shoulder panel section and the first and second wall panel sections extending upwardly and inwardly to partially overlie the bottom of the container when the wall panel sections are in an upright orientation and the container is erected;

the front shoulder panel section comprising a spout receiving opening sized for insertion of the spout of the internal liquid container therethrough;

a first shield panel portion extending inwardly from the upper edge of the front shoulder panel section, the first shield panel comprising a first proximal end portion coupled to the upper edged of the front shoulder panel section and a first distal end portion spaced inwardly from the front wall shoulder portion and from the upper edge of the front wall shoulder panel section, a second shield panel portion having a second proximal end portion coupled to the upper edge of the rear wall panel section and a second distal end portion spaced inwardly from the front wall shoulder portion and from the upper edge of the front wall shoulder panel section, the first and second distal end portions having interlocking features for joining the first and second distal end portions together such that the first and second shield panel sections overlay the internal liquid container;

an inner top panel section coupled to the upper edge of the first side wall shoulder panel section and an outer top panel section coupled to the upper edge of the second side wall shoulder panel section, the outer top panel section overlaying the inner top a panel section and the first and second shield panel portions, a hand hold opening being provided through the inner and outer top panel portions.

23. A beverage container according to claim 22 comprising a rear shoulder panel section having upper and lower rear shoulder panel edges, the lower rear shoulder panel edge being coupled to the upper edge of the rear wall panel section, the rear shoulder panel section extending upwardly and inwardly to partially overlie the bottom of the container when the wall panel sections are in an upright orientation and the container is erected, and wherein the inner and outer top panel sections extend outwardly to overhang at least a portion of the rear shoulder panel section.

24. A beverage container according to claim 22 comprising a gap between the hand hold opening and the first and second shield panel portions.

25. A beverage container for housing an internal liquid container with a spout, the beverage container comprising:

a container housing having a bottom and side walls for receiving the internal liquid container when placed in the container housing, a first of the side walls comprising a spout receiving opening;

thermal shield means positioned within the container housing and at least partially over the internal liquid container when placed in the bag for providing a thermal shield for liquid when liquid is in the internal liquid container;

first top panel means and second top panel means, the second top panel means configured to overlay the first top panel means, the first and second top panel means overlaying the shield means and comprising a hand hold opening through the first and second top panel means; and wherein the thermal shield means is configured to provide a gap between the hand hold opening and the top panel means.

26. A beverage container according to claim 25 wherein the side walls comprise upper shoulder section forming means angled upwardly and inwardly from remaining portions of the side walls, one of the side walls comprising a front side wall and another of the side walls comprising a rear side wall, the spout receiving opening being provided through the upper shoulder forming section of the front side wall, and wherein the first and second top panel means comprise means overhanging and positioned above the shoulder forming means of the rear side wall.

* * * * *